US008123325B2

(12) United States Patent
Yamazaki

(10) Patent No.: US 8,123,325 B2
(45) Date of Patent: Feb. 28, 2012

(54) NON-EJECTING NOZZLE DETECTING METHOD AND DEVICE AND INKJET RECORDING APPARATUS

(75) Inventor: Yoshirou Yamazaki, Ashigara-kami-gun (JP)

(73) Assignee: Fujifilm Corporation, Tokyo (JP)

( * ) Notice: Subject to any disclaimer, the term of this patent is extended or adjusted under 35 U.S.C. 154(b) by 509 days.

(21) Appl. No.: 12/414,066

(22) Filed: Mar. 30, 2009

(65) Prior Publication Data

US 2009/0244120 A1 Oct. 1, 2009

(30) Foreign Application Priority Data

Mar. 31, 2008 (JP) ..... 2008-094197
Mar. 31, 2008 (JP) ..... 2008-094374

(51) Int. Cl.
*B41J 29/393* (2006.01)
*B41J 29/38* (2006.01)

(52) U.S. Cl. ..... 347/19; 347/6; 347/9; 347/14

(58) Field of Classification Search ..... 347/6, 9, 347/14, 19

See application file for complete search history.

(56) References Cited

U.S. PATENT DOCUMENTS

| | | | | |
|---|---|---|---|---|
| 5,898,443 | A | 4/1999 | Yoshino et al. | |
| 6,371,609 | B1 * | 4/2002 | Oikawa | 347/19 |
| 7,182,424 | B2 | 2/2007 | Kubota | |
| 2007/0146410 | A1 * | 6/2007 | Kawakami et al. | 347/21 |

FOREIGN PATENT DOCUMENTS

| | | | |
|---|---|---|---|
| JP | 8-118616 | A | 5/1996 |
| JP | 2004-223846 | A | 8/2004 |
| JP | 2004-223847 | A | 8/2004 |
| JP | 2008012801 | A * | 1/2008 |

* cited by examiner

*Primary Examiner* — Matthew Luu
*Assistant Examiner* — Jannelle M Lebron
(74) *Attorney, Agent, or Firm* — Birch, Stewart, Kolasch & Birch, LLP

(57) ABSTRACT

A non-ejecting nozzle detecting method comprises: setting a specified processing liquid deposited pattern; ejecting the processing liquid from processing liquid nozzles onto a recording medium to form the processing liquid deposited pattern; ejecting colored ink from ink nozzles corresponding to the processing liquid nozzles selected as non-ejection detection targets onto the processing liquid deposited pattern, and recording linear colored ink images on the recording medium to thereby form a processing liquid non-ejection detection pattern; detecting, based on changes in densities and line widths of the linear colored ink images, a non-ejecting processing liquid nozzle from the processing liquid nozzles selected as the non-ejection detection targets.

16 Claims, 17 Drawing Sheets

NON-EJECTING NOZZLE DETECTING METHOD AND DEVICE AND INKJET RECORDING APPARATUS

The entire contents of literature cited in this specification are incorporated herein by reference.

BACKGROUND OF THE INVENTION

The present invention relates to a non-ejecting nozzle detecting method and device, and more particularly, to a method and device for detecting a non-ejecting processing liquid nozzle in an inkjet recording apparatus having nozzles that eject processing liquid for agglomerating colored inks.

Conventionally, when an image is printed on a recording medium in an inkjet recording apparatus, there has been a case in which water resistance of a recorded image is insufficient depending on a type of the recording medium.

In particular, when a color image is recorded, if a large quantity of ink is ejected on a recording medium in an attempt to print a high-density image, feathering may be caused depending on penetration of the ink into the recording medium. On the other hand, if it is attempted to print a high-density image while suppressing the penetration, a blur may be caused among inks of different colors. In both the cases, an image quality in printing a color image is substantially deteriorated.

Therefore, in recent years, in order to improve water resistance of a printed image and obtain a high-quality image (print) in an inkjet recording apparatus, a method of using processing liquid is proposed.

The processing liquid has an action of agglomerating and fixing color materials of colored inks. Therefore, when such processing liquid is used in the inkjet recording apparatus, before the colored inks are deposited on the recording medium, the processing liquid is deposited on the recording medium and the colored inks are deposited on the processing liquid. This makes it possible to prevent feathering and a blur of the colored inks on the recording medium and obtain a high-quality image.

In this case, usually, the processing liquid is deposited over an image recording area (image wise) of the colored inks on the recording medium by an inkjet head.

In ejecting the processing liquid, if there is a nozzle that does not eject the processing liquid among nozzles of the inkjet head, an area on which the processing liquid is not deposited is formed on the recording medium.

Naturally, if the colored inks are deposited on the area on which the processing liquid is not deposited on the recording medium, fixing and agglomeration of the color materials of the colored inks is insufficient. Therefore, desired ink density and a desired dot diameter are not obtained and the image quality is deteriorated.

In particular, when the inkjet head has a line head configuration, if a non-ejecting nozzle is present, the processing liquid is not deposited on an area on a recorded image and an image quality in the area is deteriorated, and hence the area appears like a line (streak) and is extremely conspicuous.

As the processing liquid, colorless and transparent processing liquid is used in order to accurately control color density of a recorded image area on the recording medium. Therefore, it is extremely difficult to detect whether or not the processing liquid is deposited on the recording medium, but it is extremely important in maintaining a quality of a recorded image to detect whether or not the processing liquid is deposited on an area on which the ink is to be deposited (image recording area).

Therefore, conventionally, there is known a technology of detecting the colorless and transparent processing liquid by performing test print prior to formal print.

For example, JP 08-118616 A discloses a method of forming comparing densities, hues, blurs, and the like of a line formed by depositing a colored ink one on top of processing liquid and a line formed by depositing only the colored ink, and detecting a non-ejecting nozzle using a result of the comparison. JP 08-118616 A also discloses a method of, after depositing processing liquid on a recording medium to form a stepped line, depositing a colored ink (solid deposited) over the entire surface of the recording medium, calculating density, a color, and the like of a line on which the processing liquid and the ink overlap, and detecting a non-ejecting nozzle using the density, the color, and the like.

JP 2004-223846 A and JP 2004-223847 A each disclose a method of, after depositing processing liquid and colored inks one on top of another to form dots and, on the other hand, depositing only the colored inks to form dots on a recording medium, calculating the density and dot diameters of the formed dots and detecting, using the density and the dot diameters, a non-ejecting nozzle that is not ejecting the processing liquid.

According to the method disclosed in JP 08-118616 A, a non-ejecting processing liquid nozzle can be detected. However, in the method of comparing a line formed by depositing processing liquid and colored inks one on top of another and a line formed by depositing only the colored inks, when the processing liquid and the colored inks are deposited one on top of another, if deposited positions of the colored inks are not extremely stable, it is extremely highly likely that some colored inks do not overlap the processing liquid and are not fixed. At the same time, only the colored inks are deposited to form a line, and hence an area in which the deposited colored inks are not fixed is formed on a recording medium.

Further, among the methods disclosed in JP 08-118616 A, in the method of, after forming a stepped line with processing liquid, depositing colored inks over the entire surface of a recording medium, an area without the processing liquid, that is, an area on which only the colored inks are deposited and are not fixed is formed in an extremely wide range on the recording medium.

If the recording medium having the area on which the colored inks are not fixed in this way is conveyed, conveying rollers and the like are contaminated by the unfixed inks.

Further, if the conveying rollers and the like for the recording medium are contaminated in test print for detecting a non-ejecting processing liquid nozzle, stains adhere to the recording medium in normal printing.

In the method disclosed in JP 08-118616 A, in order to detect that deposited positions of the colored inks fluctuate (positional shift), instead of an ink nozzle fluctuating in the deposited positions, it is necessary to determine anew, with respect to a processing liquid nozzle, an ink nozzle used in detecting a non-ejecting processing liquid nozzle. Therefore, association between processing liquid nozzles and ink nozzles has to be set again and takes time.

In the method disclosed in JP 2004-223846 A and JP 2004-223847 A, it is possible to detect a non-ejecting nozzle that is not ejecting processing liquid, but every dot has to be measured by the charge-coupled device (CCD) camera and compared with a predetermined reference value. Therefore, large cost and time are required to detect a non-ejecting nozzle.

Further, in the method disclosed in JP 2004-223846 A and JP 2004-223847 A, it is possible to detect that deposited positions of colored inks fluctuate, but, instead of an ink nozzle fluctuating in the deposited positions, it is necessary to determine anew an ink nozzle used in detecting a non-ejecting processing liquid nozzle. Therefore, association between processing liquid nozzles and ink nozzles has to be set again.

SUMMARY OF THE INVENTION

It is an object of the present invention to solve the above-mentioned problems of the related arts and provide a non-ejecting nozzle detecting method and a non-ejecting nozzle detecting device that are capable of detecting, without contaminating a recording medium and conveying means for the recording medium with colored inks, a non-ejecting nozzle that is not ejecting processing liquid.

It is also an object of the present invention to provide an inkjet recording apparatus including such a non-ejecting nozzle detecting device as described above.

A non-ejecting nozzle detecting method according to a first aspect of the present invention comprises:

setting a processing liquid deposited pattern so that, by processing liquid nozzles selected not to be adjacent to one another as non-ejection detection targets, linear non-ejection detection target areas are formed in which the processing liquid is continuously deposited for a predetermined number of dots while gradually changing density of the processing liquid to be deposited to one of increase and decrease in one direction, and, by remaining processing liquid nozzles not selected as the non-ejection detection targets, the processing liquid is continuously deposited while the density of the processing liquid is changed in a direction opposite to the one direction of the linear non-ejection detection target areas;

ejecting the processing liquid from the processing liquid nozzles onto the recording medium to form the processing liquid deposited pattern on the recording medium according to the set processing liquid deposited pattern;

ejecting the colored ink from the ink nozzles corresponding to the processing liquid nozzles selected as the non-ejection detection targets onto the processing liquid deposited pattern, and recording linear colored ink images on the recording medium to thereby form a processing liquid non-ejection detection pattern on the recording medium;

scanning the processing liquid non-ejection detection pattern with a detection sensor;

detecting the linear colored ink images in the processing liquid non-ejection detection pattern scanned by the detection sensor;

measuring densities and line widths of the detected linear colored ink images; and detecting, based on changes in the measured densities and line widths of the linear colored ink images, a non-ejecting processing liquid nozzle from the processing liquid nozzles selected as the non-ejection detection targets.

A non-ejecting nozzle detecting device according to a second aspect of the present invention comprises:

a nozzle setting unit that selects processing liquid nozzles not to be adjacent to one another out of all the processing liquid nozzles as non-ejection detection targets;

a processing liquid deposited pattern setting unit that sets a processing liquid deposited pattern so that the processing liquid nozzles selected as the non-ejection detection targets continuously deposit the processing liquid for a predetermined number of dots while gradually changing density of the processing liquid to be deposited to one of increase and decrease in one direction to form linear non-ejection detection target areas, and remaining processing liquid nozzles not selected as the non-ejection detection targets continuously deposit the processing liquid while the density of the processing liquid is changed in a direction opposite to the one direction of the linear non-ejection detection target areas;

an ejection control unit that performs ejection control for the processing liquid nozzles to eject the processing liquid from the processing liquid nozzles onto the recording medium to form the processing liquid deposited pattern on the recording medium according to the set processing liquid deposited pattern, and performs ejection control for the ink nozzles to eject the colored ink from the ink nozzles corresponding to the processing liquid nozzles selected as the non-ejection detection targets onto the processing liquid deposited pattern and record a linear colored ink images on the recording medium to thereby form a processing liquid non-ejection detection pattern on the recording medium;

a data acquiring unit that scans the processing liquid non-ejection detection pattern with a detection sensor and acquires image data of the linear colored ink image in the scanned processing liquid non-ejection detection pattern;

a measuring unit that measures densities and line widths of the linear colored ink images; and a detecting unit that detects, based on changes in the densities and the line widths of the linear colored ink images measured by the measuring unit, a non-ejecting processing liquid nozzle from the processing liquid nozzles selected as the non-ejection detection targets.

A non-ejecting nozzle detecting method according to a third aspect of the present invention comprises:

setting a processing liquid deposited pattern so that, by processing liquid nozzles selected as non-ejection detection targets not to be adjacent to one another, linear non-ejection detection target areas are formed each of which includes a processing liquid deposited area on which the processing liquid is continuously deposited for a predetermined number of dots and a processing liquid non-deposited area on which the processing liquid is not continuously deposited for the predetermined number of dots adjacent to the processing liquid deposited area, and by remaining processing liquid nozzles not selected as the non-ejection detection targets, the processing liquid is continuously deposited;

ejecting the processing liquid from the processing liquid nozzles onto the recording medium to form the processing liquid deposited pattern on the recording medium according to the set processing liquid deposited pattern;

ejecting the colored ink from the ink nozzles corresponding to the processing liquid nozzles selected as the non-ejection detection targets onto the processing liquid deposited pattern, and recording a linear colored ink image on the recording medium to form a processing liquid non-ejection detection pattern on the recording medium;

scanning the processing liquid non-ejection detection pattern with a detection sensor;

detecting the linear colored ink image in the processing liquid non-ejection detection pattern scanned by the detection sensor;

measuring densities and line widths of the detected linear colored ink images; and detecting, based on changes in the measured densities and line widths of the linear colored ink images, a non-ejecting processing liquid nozzle from the processing liquid nozzles selected as the non-ejection detection targets.

A non-ejecting nozzle detecting device according to a fourth aspect of the present invention comprises:

a nozzle setting unit that selects processing liquid nozzles not to be adjacent to one another out of all the processing liquid nozzles as non-ejection detection targets;

a processing liquid deposited pattern setting unit that sets a processing liquid deposited pattern so that the processing liquid nozzles selected as non-ejection detection targets form linear non-ejection detection target areas each of which includes a processing liquid deposited area on which the processing liquid is continuously deposited for a predetermined number of dots and a processing liquid non-deposited area on which the processing liquid is not continuously deposited for the predetermined number of dots adjacent to the processing liquid deposited area, and by remaining processing liquid nozzles not selected as the non-ejection detection targets, the processing liquid is continuously deposited;

an ejection control unit that performs ejection control for the processing liquid nozzles to eject the processing liquid from the processing liquid nozzles onto the recording medium to form the processing liquid deposited pattern on the recording medium according to the set processing liquid deposited pattern, and performs ejection control for the ink nozzles to eject the colored ink from the ink nozzles corresponding to the processing liquid nozzles selected as the non-ejection detection targets onto the processing liquid deposited pattern and record a linear colored ink images on the recording medium to thereby form a processing liquid non-ejection detection pattern on the recording medium;

a data acquiring unit that scans the processing liquid non-ejection detection pattern with a detection sensor and acquires image data of the linear colored ink image in the scanned processing liquid non-ejection detection pattern;

a measuring unit that measures densities and line widths of the linear colored ink images; and a detecting unit that detects, based on changes in the densities and the line widths of the linear colored ink images measured by the measuring unit, a non-ejecting processing liquid nozzle from the processing liquid nozzles selected as the non-ejection detection targets.

DESCRIPTION OF THE PREFERRED EMBODIMENTS

Embodiments of the present invention are described in detail below with reference to the accompanying drawings.

First Embodiment

Figure 1:
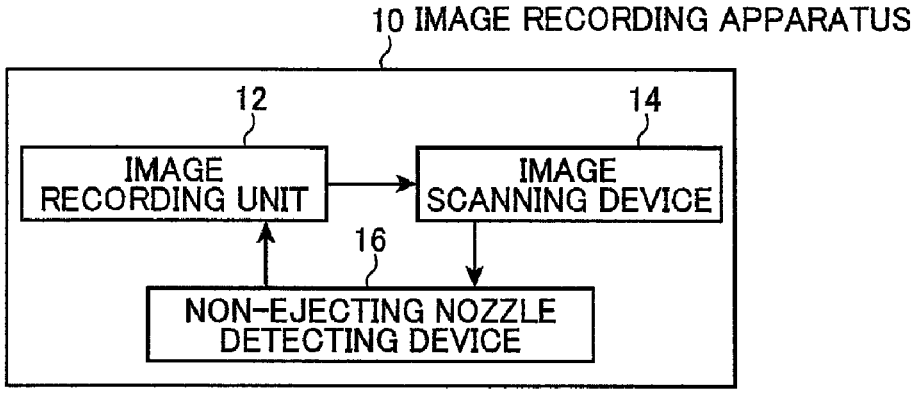
FIG. 1 is a block diagram of a configuration of an example an image recording apparatus to which the present invention is applied.

FIG. 1 is a diagram of a configuration of an image recording apparatus 10 to which the present invention is applied.

The image recording apparatus 10 is an inkjet recording apparatus that records, according to supplied image information, an image on a recording medium with the use of colored inks for forming an image and processing liquid for fixing the colored inks. The image recording apparatus 10 includes an image recording unit 12, an image scanning device 14, and a non-ejecting nozzle detecting device 16 according to this embodiment of the present invention.

The image recording unit 12 includes an inkjet head (hereinafter, simply referred to as ejection head) having ink ejection nozzles (hereinafter, also simply referred to as ink nozzles) and processing-liquid ejection nozzles (hereinafter, also simply referred to as processing liquid nozzles) and conveying means for conveying a recording medium. The image recording unit 12 records an image on a supplied recording medium according to supplied image information and forms, for example, particularly in the present invention, a processing liquid deposited pattern by the processing-liquid ejection nozzles and a processing liquid non-ejection detection pattern by the processing-liquid ejection nozzles and the ink ejection nozzles.

The image scanning device 14 scans the image recorded on the recording medium by the image recording unit 12 with the use of a detection sensor including a photographing device including a charge-coupled device (CCD) or a metal oxide semiconductor (MOS) sensor, converts data of the scanned image into digital data, and supplies the digital data to the non-ejecting nozzle detecting device 16. As the image scanning device 14, a publicly-known scanner can be used.

The non-ejecting nozzle detecting device (hereinafter also simply referred to as detecting device) 16 detects a processing-liquid ejection nozzle that is not ejecting the processing liquid (hereinafter also referred to as non-ejecting processing liquid nozzle) among the processing-liquid ejection nozzles configuring the ejection head of the image recording unit 12. Preferably, the detecting device 16 detects an ink ejection nozzle that is not ejecting the colored ink (hereinafter also referred to as non-ejecting ink nozzles) among the ink nozzles configuring the ejection head of the image recording unit 12. More preferably, the detecting device 16 also detects positional shift between the processing-liquid ejection nozzles and the ink ejection nozzles. Still more preferably, the detecting device 16 corrects this positional shift and sets new association between the processing-liquid ejection nozzles and the ink ejection nozzles.

Figure 2:
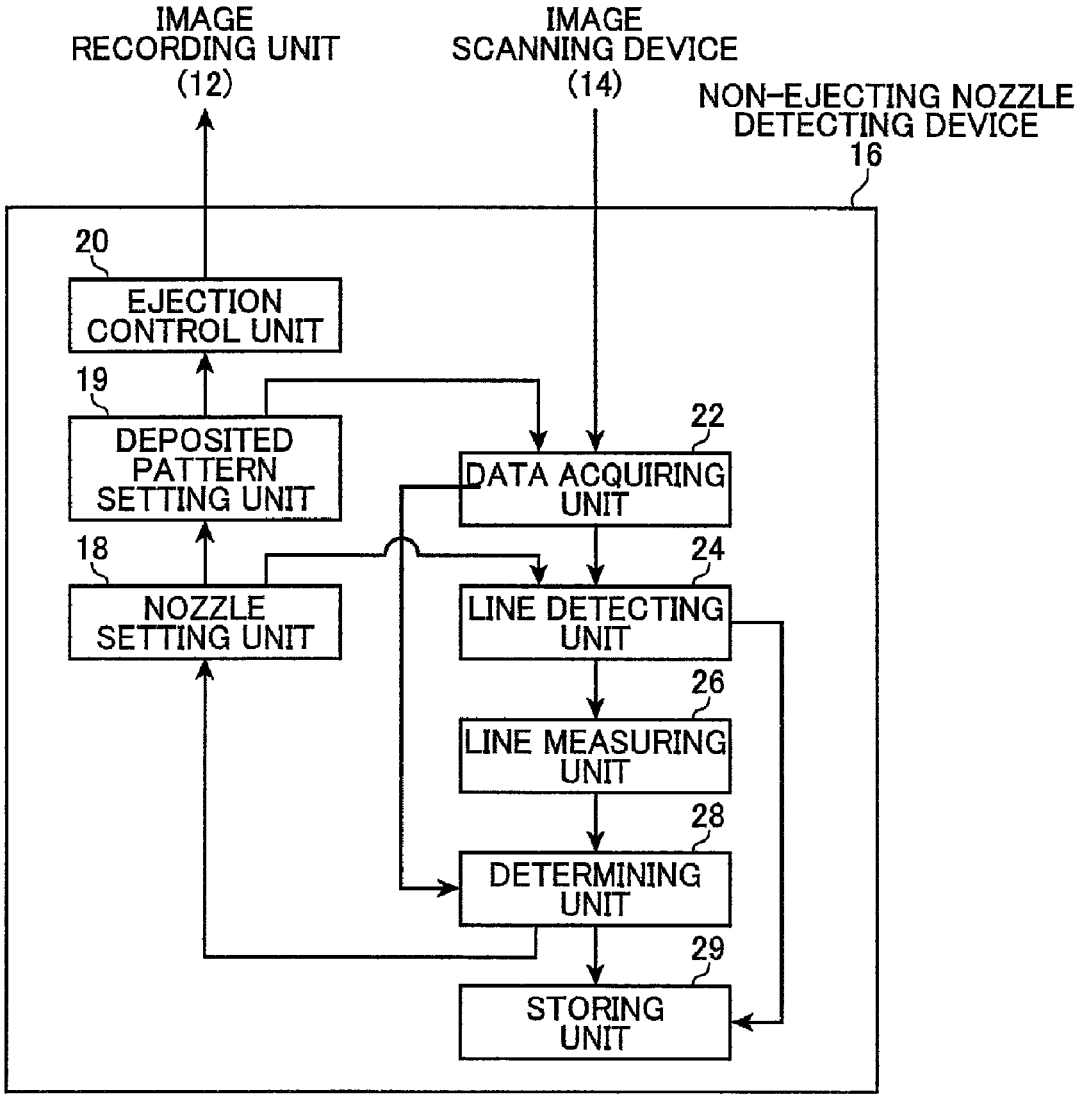
FIG. 2 is a block diagram of a configuration of a non-ejecting nozzle detecting device according to a first embodiment of the present invention.

As illustrated in FIG. 2, the detecting device 16 includes a nozzle setting unit 18, a deposited pattern setting unit 19, an ejection control unit 20, a data acquiring unit 22, a line detecting unit 24, a line measuring unit 26, a determining unit 28, and a storing unit 29.

The nozzle setting unit 18 performs, for example, number setting for the processing-liquid ejection nozzles (hereinafter also referred to as processing liquid nozzle), number setting for the processing liquid nozzles as non-ejecting processing liquid nozzle determination targets (hereinafter also referred to as target processing liquid nozzles), and determination of an ink ejection nozzle corresponding to the target processing liquid nozzle (hereinafter also referred to as corresponding ink nozzle) or determination of ink nozzles located around the target processing liquid nozzle (hereinafter also referred to as peripheral ink nozzles).

When processing liquid nozzles as non-ejecting nozzle detection targets are determined in order to set a processing liquid deposited pattern, for example, target processing liquid nozzles are selected out of all the processing liquid nozzles as non-ejecting nozzle detection targets at least not to be adjacent to one another.

When processing liquid non-ejecting nozzle detection is performed from a processing liquid non-ejection detection pattern formed by the processing-liquid ejection nozzles and the ink ejection nozzles, a predetermined processing liquid nozzle, for example, a processing liquid nozzle at one end of the ejection head or the next processing liquid nozzle of a processing liquid nozzle subjected to the processing liquid non-ejecting nozzle detection is selected as a target processing liquid nozzle. A nozzle number of the selected target processing liquid nozzle is sent to the line detecting unit 24.

In order to detect a non-ejecting processing liquid nozzle according to the processing liquid nozzles as the non-ejecting nozzle detection targets set by the nozzle setting unit 18, the deposited pattern setting unit 19 sets a processing liquid deposited pattern as a test pattern for depositing the processing liquid using all the processing liquid nozzles. In the deposited pattern setting unit 19, the processing liquid deposited pattern is generated as test pattern data for processing liquid deposited (hereinafter referred to as processing liquid pattern data).

For example, the processing liquid deposited pattern is set so that, in each of the processing liquid nozzles selected as the non-ejecting nozzle detection targets out of all the processing liquid nozzles, a linear non-ejection detection target area on which the processing liquid is continuously deposited for a predetermined number of dots while the density of the processing liquid is changed to gradually increase or decrease in one direction is formed and so that, in the remaining processing liquid nozzles not selected as the non-ejecting nozzle detection targets, the processing liquid is continuously deposited while the density of the processing liquid is changed in a direction opposite to that in the linear non-ejection detection target area.

A specific example of the processing liquid deposited pattern (see FIG. 7) is described later.

In the present invention, it is possible to control the density of the processing liquid by controlling at least one of a liquid quantity of the processing liquid deposited on one processing liquid dot from the processing liquid nozzle, the size of the one processing liquid dot, the density of the processing liquid forming the one processing liquid dot, and an ejection ratio of the processing liquid on the one processing liquid dot. The level of the processing liquid density corresponds to the liquid quantity of the processing liquid, the size, the density, or the ejection ratio.

The ejection control unit 20 generates, according to processing liquid pattern data of the processing liquid deposited pattern set by the deposited pattern setting unit 19, test pattern data for ink deposited (hereinafter, referred to as ink pattern data) for depositing the colored inks with the use of the corresponding ink nozzle and the peripheral ink nozzles. The ejection control unit 20 supplies the processing liquid pattern data and the ink pattern data to the image recording unit 12 and controls operations of the image recording unit 12. In other words, the image recording unit 12 is controlled so as to eject and deposit the processing liquid from the processing liquid nozzles of the ejection head according to the supplied processing liquid pattern data to form a processing liquid deposited pattern (see FIG. 7) on the recording medium and so as to eject and deposit the colored inks on the recording medium from the ink nozzles of the ejection head according to the supplied ink pattern data, record a linear colored ink image (hereinafter, simply referred to as line image) on the recording medium, and form a test pattern, that is, a processing liquid non-ejection detection pattern (see FIG. 8).

After the processing liquid non-ejection detection pattern formed by the image recording unit 12 based on the control by the ejection control unit 20 is scanned by the image scanning device 14, the data acquiring unit 22 acquires, from the image scanning device 14, image data of the processing liquid non-ejection detection pattern (test pattern) used for detecting non-ejecting processing liquid nozzles (hereinafter, also simply referred to as test image data), and reference pattern data used for determination performed in the determining unit 28. The data acquiring unit 22 further acquires processing liquid pattern data of the processing liquid deposited pattern from the deposited pattern setting unit 19.

The test image data, the reference pattern data, and the processing liquid pattern data are described in detail later.

The line detecting unit 24 detects, from test image data acquired by the data acquiring unit 22, data of a line image (hereinafter, simply referred to as line data) printed by the corresponding ink nozzle or the peripheral ink nozzles and supplies the detected line data to the line measuring unit 26.

The line measuring unit 26 measures density on the recording medium, of the line image recorded in the line data (hereinafter, also simply referred to as density of the line image) and line width of the line image recorded in the line data (line width in a direction orthogonal to a recording medium conveying direction on the recording medium; also simply referred to as width of the line image).

The determining unit 28 determines whether the target processing liquid nozzle is a non-ejecting processing liquid nozzle. The determining unit 28 further determines ink ejection states of the corresponding ink nozzle and the peripheral ink nozzles, a positional relation between landing positions of the processing liquid and the ink ejected from the target processing liquid nozzle and the corresponding ink nozzle (or the peripheral ink nozzles), update of the corresponding ink nozzle, and the like and supplies results of the determination to the storing unit 29.

A method of determining whether the target processing liquid nozzle is a non-ejecting processing liquid nozzle is described later.

The storing unit 29 stores determination result recording data such as a nozzle number of a non-ejecting processing liquid nozzle, positional shift between the target processing liquid nozzle and the corresponding ink nozzle, a positional relation between the target processing liquid nozzle and the corresponding ink nozzle or the peripheral ink nozzles, and updated nozzle numbers of the corresponding ink nozzle (change to a peripheral ink nozzle). Publicly-known storing means such as a server can be used as the storing unit 29.

A non-ejecting nozzle detecting method is described with reference to FIG. 3.

Figure 8:
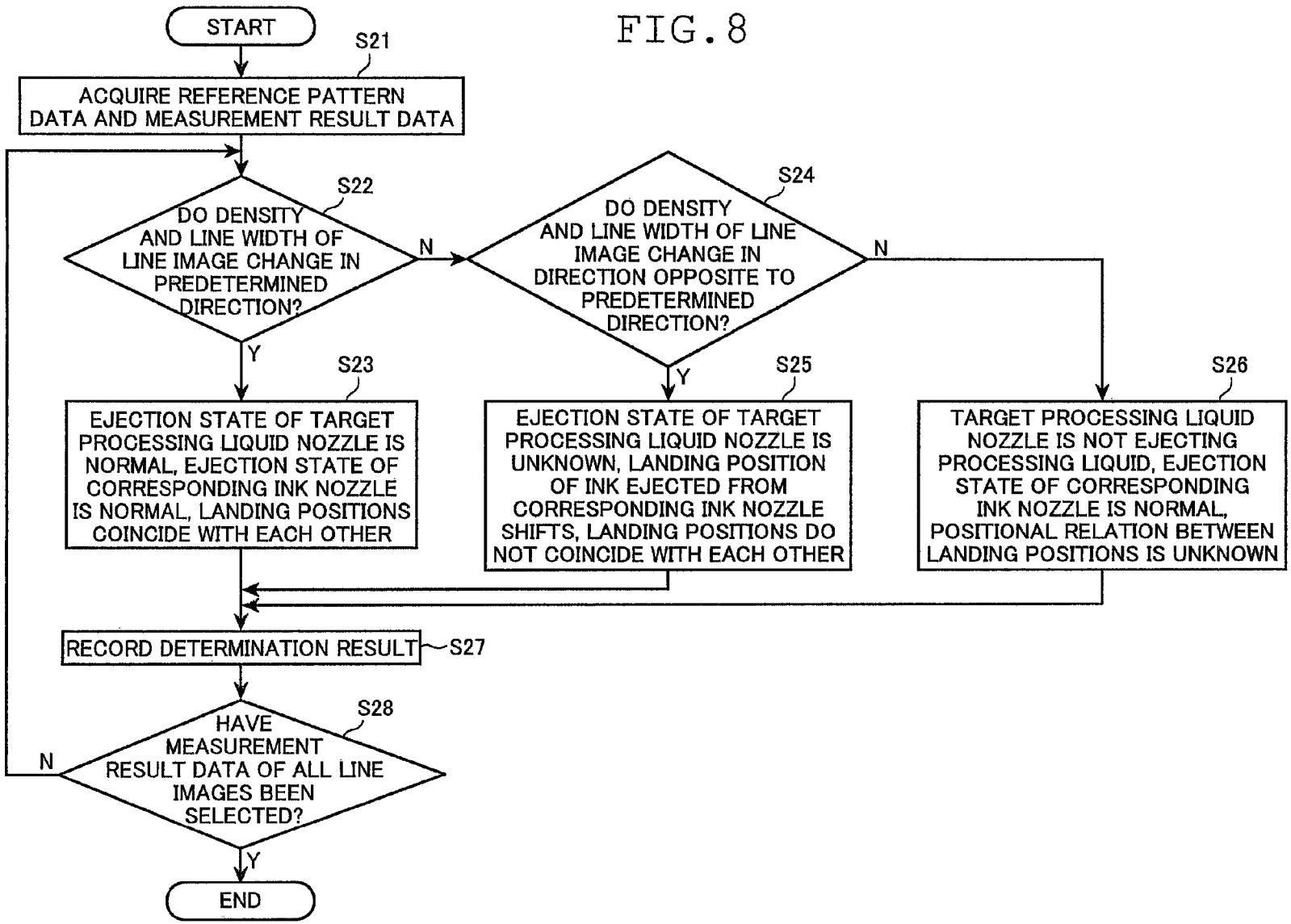
FIG. 8 is a flowchart of a method of determining whether one target processing liquid nozzle is ejecting processing liquid in the first embodiment.

It is assumed that a test pattern, for example, a processing liquid non-ejection detection pattern illustrated in FIG. 8 is formed in advance.

First, in Step S1, the data acquiring unit 22 acquires reference pattern data and test image data from the image scanning unit 14. The reference pattern data is supplied to the determining unit 28 and the test image data is supplied to the line detecting unit 24.

The reference pattern data and the test image data are described in detail later.

Subsequently, in Step S2, the nozzle setting unit 18 sets a number of the target processing liquid nozzle to an initial value.

For example, when numbers SN1, SN2, SN3, . . . are set for the respective processing liquid nozzles and non-ejecting processing liquid nozzles are detected, if detection of non-ejecting processing liquid nozzles is always started with the processing liquid nozzle SN1 set as the target processing liquid nozzle, the nozzle setting unit 18 resets the number of the target processing liquid nozzle to the initial value SN1.

After resetting the number of the target processing liquid nozzle to the initial value, in Step S3, the nozzle setting unit 18 determines an ink nozzle that deposits the ink on the processing liquid deposited by the target processing liquid nozzle, that is, an ink nozzle corresponding to the target processing liquid nozzle (corresponding ink nozzle).

A method of determining the corresponding ink nozzle is not specifically limited. However, usually, the processing liquid nozzles and the ink nozzles are arranged in the ejection head so that the ink is deposited in positions in which the processing liquid is deposited. Therefore, as an example, there is a method of determining an ink nozzle corresponding to the target processing liquid nozzle with the use of arrangement data.

In Step S4, the line detecting unit 24 detects, from the test image data, data of a line image (line data) recorded by the corresponding ink nozzles determined in Step S3 and supplies the line data to the line measuring unit 26.

A method of detecting the line data from the test image data is not specifically limited. As an example, there is a method of detecting the line data using, for example, information concerning a starting position for drawing by the ink nozzles on the recording medium.

When line data cannot be detected, in Step S5, the line detecting unit 24 determines that the corresponding ink nozzle is a non-ejecting ink nozzle that is not ejecting the ink, determines that it is unknown whether the target processing liquid nozzle has ejected the processing liquid, and determines that a positional relation between a landing position of the processing liquid ejected from the target processing liquid nozzle and a landing position of the ink ejected from the corresponding ink nozzle is also unknown.

When line data is detected in Step S4, in Step S6, the line measuring unit 26 measures the density of the line image and the line width of the line image from a value of the supplied line data and supplies measurement result data in which a result of the measurement is recorded to the determining unit 28.

Subsequently, in Step S7, the determining unit 28 determines, using the measurement result data supplied from the line measuring unit 26 and the reference pattern data supplied from the data acquiring unit 22, whether the target processing liquid nozzle is ejecting the processing liquid and whether the corresponding ink nozzle is ejecting the ink, and determines a positional relation between landing positions of the processing liquid and the ink ejected from the target processing liquid nozzle and the corresponding ink nozzle.

A method of determining whether the target processing liquid nozzle is ejecting the processing liquid and whether the corresponding ink nozzle is ejecting the ink and determining a positional relation between landing positions of the processing liquid and the ink ejected from the target processing liquid nozzle and the corresponding ink nozzle is described in detail later.

In Step S8, the storing unit 29 records a result of the determination in Step S5 or S7 as determination result recording data.

In Step S9, the nozzle setting unit 18 checks whether all the processing liquid nozzles are set as target processing liquid nozzles.

When all the processing liquid nozzles are not set as the target processing liquid nozzles, in Step S10, the nozzle setting unit 18 increments the set number of the target processing liquid nozzle by one.

For example, if the present number of the target processing liquid nozzle is SN1, the nozzle setting unit 18 sets a number of the next target processing liquid nozzle to SN2.

After the set number of the target processing liquid nozzle is incremented by one, the processing in Steps S3 to S9 is repeated.

When it is confirmed in Step S9 that all the processing liquid nozzles are set as target processing liquid nozzles, in Step S11, the determination result recording data is supplied to the storing unit 29, and the detection of non-ejecting processing liquid nozzles is finished.

A method of determining whether the target processing liquid nozzle is ejecting the processing liquid is described below.

Reference pattern data and measurement result data used for determining whether the target processing liquid nozzle is ejecting the processing liquid are described in detail.

The reference pattern data is used for determining whether the target processing liquid nozzle is ejecting the processing liquid. The reference pattern data is data of an image having the density and the line width changing according to the density of the processing liquid by depositing, as a reference image, the ink on an area on which the processing liquid is deposited by changing the density in one direction.

The reference image is described with reference to FIGS. 4 and 5.

Figure 4:
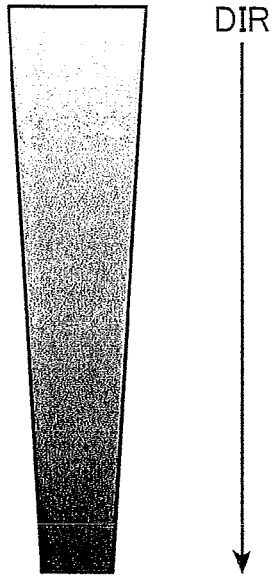
FIG. 4 is a schematic diagram of a reference image used in the first embodiment.
Figure 5:
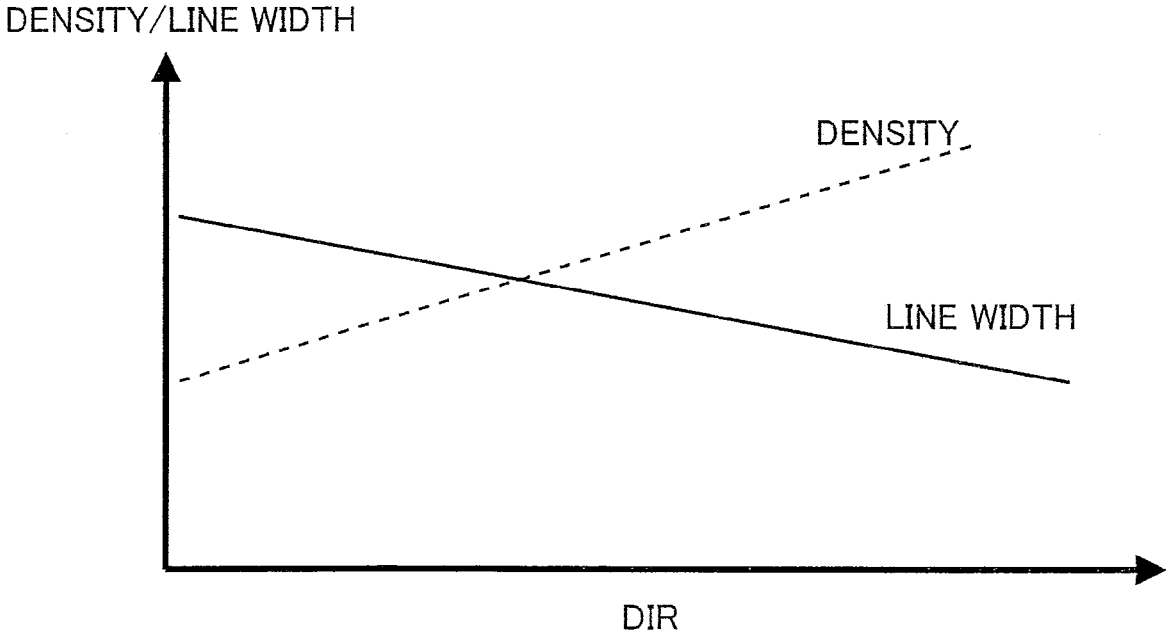
FIG. 5 is a graph of changes in density and line width of the reference image used in the first embodiment.

FIG. 4 is a schematic diagram of the reference image. FIG. 5 is a graph representing changes in the density and the line width of the reference image.

The processing liquid has an action of agglomerating and fixing color materials of colored inks on a recording medium. Therefore, when an amount of the processing liquid is small compared with that of the ink, that is, the density of the processing liquid is low, the ink does not fix on the recording medium and tends to blur on the recording medium. Consequently, a formed image is an image having low density and large width. On the other hand, when an amount of the processing liquid is large compared with that of the ink, that is, the density of the processing liquid is high, the ink stably fixes on the recording medium and less easily blurs on the recording medium. Therefore, a formed image is an image having high density and small width.

Therefore, for example, the ink is deposited by one ink nozzle to form an image in an area on which the processing liquid is deposited to gradually increase density per one dot toward an arrow DIR direction of FIG. 4. The formed image is, as illustrated in FIG. 5, an image in which density increases and line width decreases toward the direction in which the density of the processing liquid with respect to the ink increases.

In this way, the density of the formed image increases and the line width thereof decreases as the density of the processing liquid with respect to the ink increases. Therefore, determination concerning whether the target processing liquid nozzle is ejecting the processing liquid is performed by using the difference in characteristics of the density and the line width.

A method of generating reference pattern data is not specifically limited. As an example, there is a method described below. The processing liquid is deposited on the recording medium toward a conveying direction of the recording medium (hereinafter also simply referred to as conveying direction) so that the density per one dot gradually increases by, for example, gradually increasing an ejection amount from the processing liquid nozzle to one processing liquid dot, increasing a liquid quantity of the processing liquid, increasing the size of one processing liquid dot, or increasing the density of a predetermined quantity of the processing liquid for forming one processing liquid dot, otherwise, the density per one dot gradually decreases. The reference image illustrated in FIG. 4 is printed by depositing the ink on the recording medium toward the conveying direction of the recording medium. The reference pattern data is generated by simply scanning the reference image with the image scanning device 14 and converting data of the scanned reference image into digital data.

Measurement result data used to determine whether the target processing liquid nozzle is ejecting the processing liquid is described below.

The measurement result data is data representing a result obtained by detecting image data of a line image (line data) from test image data and measuring the density and the line width of the detected line image.

Therefore, first, the test image data is described.

In the first embodiment, the test image data is digital data representing an image including a line image formed by depositing colored inks with ink nozzles corresponding to the target processing liquid nozzle on a recording medium on which a processing liquid deposited pattern having a linear non-ejection detection target area is formed by continuously depositing the processing liquid for a predetermined number of dots while changing the density of the processing liquid to gradually increase in one direction in a processing liquid deposited line deposited by only the target processing liquid nozzle.

A method of generating the test image data is not particularly limited. An example of the method is described with reference to FIGS. 6 and 7.

Figure 6:
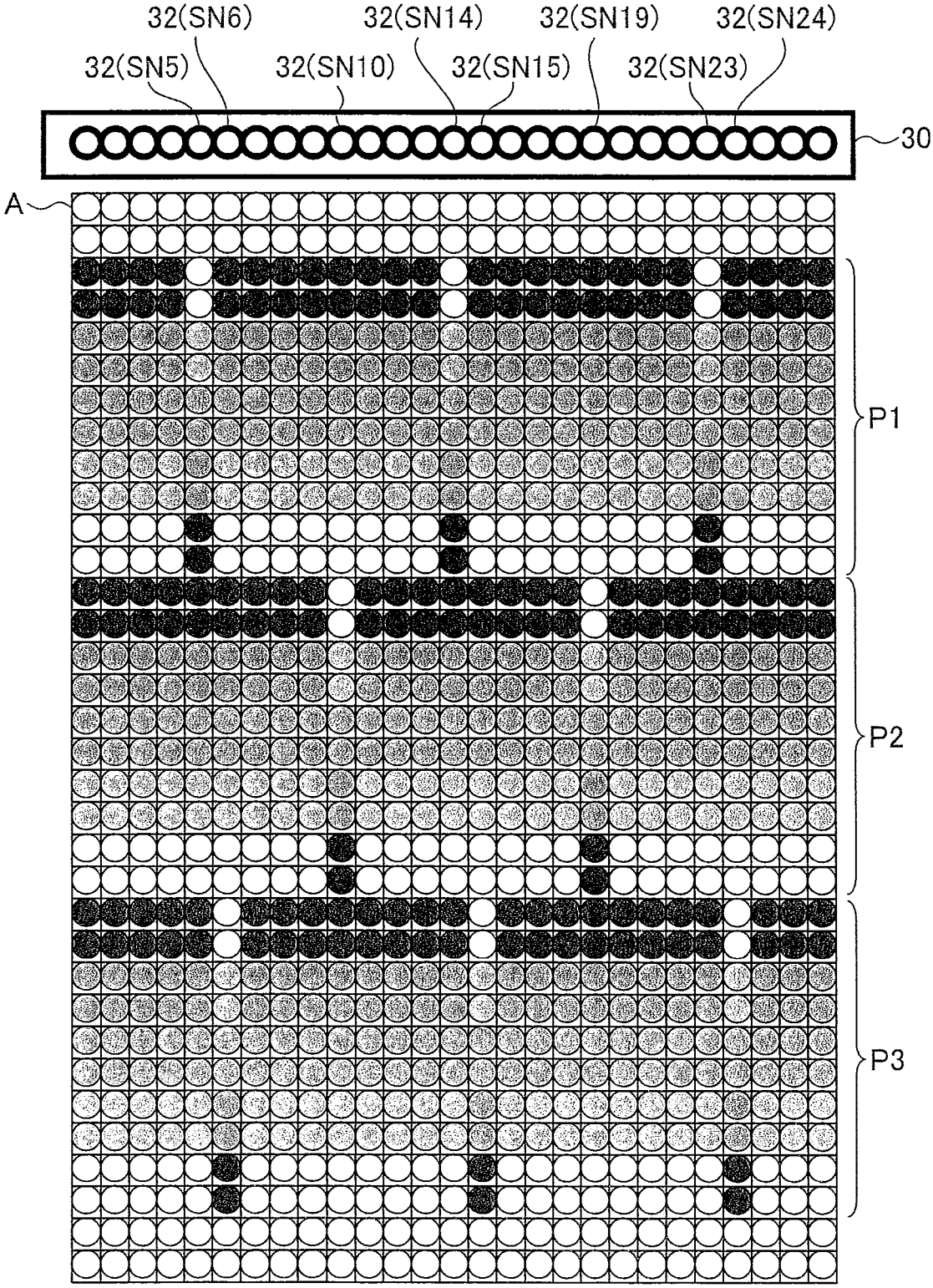
FIG. 6 is a schematic diagram of a recording medium and a processing liquid head in the first embodiment.

FIG. 6 is a schematic diagram of a recording medium A on which three kinds of processing liquid deposited patterns (P1, P2, and P3) are formed and a processing liquid ejection head 30 including twenty-seven processing liquid nozzles 32. In the processing liquid deposited patterns, a linear non-ejection detection target area is formed by continuously depositing the processing liquid for a predetermined number of dots while changing the density of the processing liquid to gradually increase in one direction only in a processing liquid deposited line formed by target processing liquid nozzles.

Figure 7:
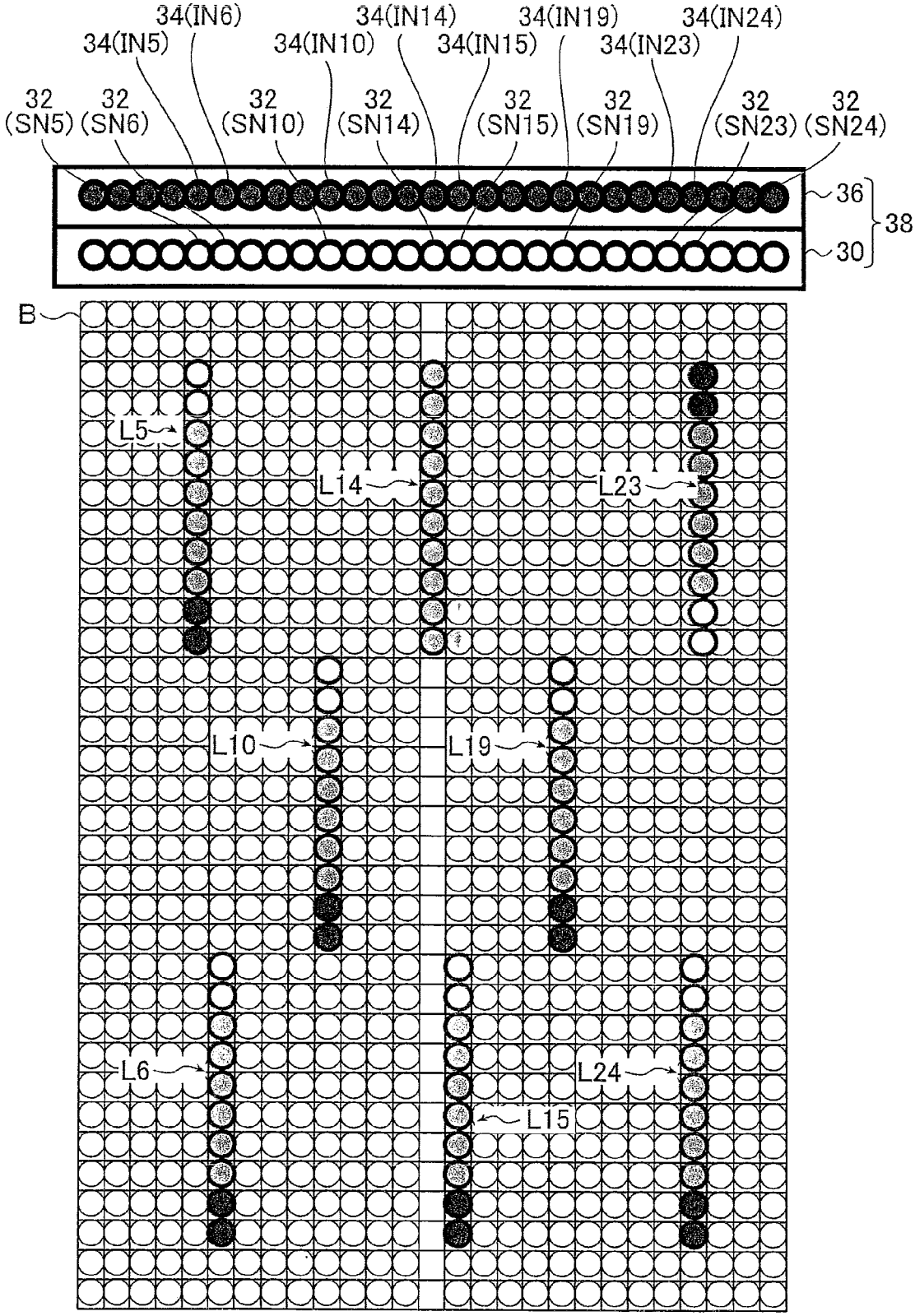
FIG. 7 is a schematic diagram of the recording medium and an ejection head in the first embodiment.

FIG. 7 is a schematic diagram of a recording medium B on which a processing liquid non-ejection detection pattern having a line image formed by depositing colored inks with corresponding ink nozzles corresponding to the target processing liquid nozzles on the recording medium A illustrated in FIG. 6 is formed, and an ejection head 38.

The processing liquid non-ejection detection pattern illustrated in FIG. 7 is an example of an image represented by the test image data.

First, for example, the recording medium A on which the processing liquid deposited patterns, in which the linear non-ejection detection target area illustrated in FIG. 6 is formed, are formed by depositing the processing liquid with the processing liquid nozzles of the processing liquid head is generated in the image recording unit 12.

It is assumed that, as illustrated in FIG. 6, in the processing liquid head 30, the twenty-seven processing liquid nozzles 32 (SN1, SN2, . . . , and SN27 from the left) are arranged in line in a lateral direction of FIG. 6.

It is assumed that the width in the lateral direction of FIG. 6 (hereinafter, referred to as row direction) of the recording medium A illustrated in FIG. 6 coincides with the length of twenty-seven processing liquid dots arranged in a row deposited by the twenty-seven processing liquid nozzles 32 arranged in a row in the same direction. It is assumed that, on the other hand, the length in a longitudinal direction of FIG. 6 (hereinafter, referred to as column direction) of the recording medium A illustrated in FIG. 6 coincides with the length of thirty-four processing liquid dots in a column deposited thirty-four times by one processing liquid nozzle 32.

In other words, it is assumed that the entire surface of the recording medium A can be coated with the processing liquid by ejecting the processing liquid for thirty-four rows with the twenty-seven processing liquid nozzles 32 in total of the processing liquid head 30.

The recording medium A including the processing liquid deposited pattern having the plurality of linear non-ejection detection target areas is generated by using the recording medium A and the processing liquid nozzles 32 as described above.

For example, as illustrated in FIG. 6, when SN5, SN6, SN10, SN14, SN15, SN19, SN23, and SN24 are set as target processing liquid nozzles, the processing liquid nozzles 32 with the numbers SN5, SN14, and SN23 deposit the processing liquid only on third to twelfth rows of the recording medium A, the processing liquid nozzles 32 with the numbers SN10 and SN19 deposit the processing liquid only on thirteenth to twenty-second rows of the recording medium A, and the processing liquid nozzles 32 with the numbers SN6, SN15, and SN24 deposit the processing liquid only on twenty-third to thirty-second rows of the recording medium A while changing the density of the processing liquid to gradually increase to form a linear non-ejection detection target area. The other processing liquid nozzles are set to eject the processing liquid while changing the density of the processing liquid to gradually decrease for every ten rows from the third row. The processing liquid head 30 and the recording medium A are relatively moved to generate the recording medium A having the entire surface on which the processing liquid is deposited.

In this way, on the recording medium A illustrated in FIG. 6, the processing liquid deposited pattern P1 having the linear non-ejection detection target area (third to twelfth rows) is formed in third to twelfth rows of a processing liquid deposited line formed by the processing liquid nozzles 32 with the numbers SN5, SN14, and SN23. The processing liquid deposited pattern P2 having the linear non-ejection detection target area (thirteenth to twenty-second rows) is formed in thirteenth to twenty-second rows of a processing liquid deposited line formed by the processing liquid nozzles 32 with the numbers SN10 and SN19. The processing liquid deposited pattern P3 having the linear non-ejection detection target area (twenty-third to thirty-second rows) is formed in twenty-third to thirty-second rows of a processing liquid deposited line formed by the processing liquid nozzles 32 with the numbers SN6, SN15, and SN24.

An ink is deposited by the corresponding ink nozzles 34 corresponding to the target processing liquid nozzles 32 with the numbers SN5, SN 6, SN10, SN14, SN15, SN19, SN23 and SN24 to form a line image on the recording medium A on which the three kinds of processing liquid deposited patterns P1 to P3 illustrated in FIG. 6 are formed. The recording medium B including a processing liquid non-ejection detection pattern having this line image is generated. In this case, the corresponding ink nozzles 34 corresponding to the target processing liquid nozzles 32 deposit the ink only on a portion of a processing liquid deposited pattern in which the target processing liquid nozzles 32 form a linear non-ejection detection target area rather than depositing the ink in all the first to thirty-four rows.

As illustrated in FIG. 7, it is assumed that, in the ink head 36, twenty-seven ink nozzles 34 having the same size as those of the processing liquid head 32 are arranged in a row in the lateral direction (row direction) of FIG. 7.

The ejection head 38 includes the processing liquid head 30 and the ink head 36.

For example, as illustrated in FIG. 7, the corresponding ink nozzles 34 corresponding to the target processing liquid nozzles 32 with the numbers SN5, SN6, SN10, SN14, SN15, SN19, SN23, and SN24 are the ink nozzles 34 with the numbers IN5, IN6, IN10, IN14, IN15, IN19, IN23 and IN24. In this case, in order to deposit the ink on the linear non-ejection detection target areas of the recording medium A illustrated in FIG. 6, the ink nozzles 34 with the numbers IN5, IN14 and IN23 deposit the ink on the third to twelfth rows on the recording medium A, the ink nozzles 34 with the numbers IN10 and IN19 deposit the ink on the thirteenth to twenty-second rows on the recording medium A, and the ink nozzles 34 with the numbers IN6, IN15 and IN24 deposit the ink on the twenty-third to thirty-second rows on the recording medium A to form line images (L5, L6, L10, L14, L15, L19, L23, and L24) and generate the recording medium B on which processing liquid non-ejection detection patterns having these line images are formed.

The recording medium B as described above is scanned by the image scanning device 14 and converted into digital data to generate test image data.

In order to generate measurement result data, line data is detected from such test image data.

In this example, only image data representing the line images L5, L6, L10, L14, L15, L19, L23, and L24 illustrated in FIG. 7 is detected from the image data of the processing liquid non-ejection detection pattern illustrated in FIG. 7.

Among the detected line images, the line images L5, L6, L10, L15, L19, and L24 are images formed by depositing the ink on an area in which the density of the processing liquid gradually increases downward in FIG. 7. On the other hand, the line image L23 is an image formed by depositing the ink on an area in which the density of the processing liquid gradually decreases downward in FIG. 7.

Among the detected line images, the line image L14 is an image formed by depositing the ink on an area on which the processing liquid is not deposited.

In the example illustrated in the figure, the line width of the line images is substantially fixed. However, actually, for example, when the density of the processing liquid gradually increases according to the density of the processing liquid, the line width of the line images gradually decreases. When the density of the processing liquid gradually decreases, the line width of the line images gradually increases.

After data pieces of the line images L5, L6, L10, L14, L15, L19, L23, and L24 are detected, the density and the width of the line images are measured to generate measurement result data.

In the measurement result data, the density of the line images L5, L6, L10, L15, L19, and L24 gradually increases downward in FIG. 7, that is, toward a direction in which the ink is recorded (hereinafter also simply referred to as recording direction). The line width thereof gradually decreases toward the same direction.

In the measurement result data, the density of the line image L23 gradually decreases downward in FIG. 7, that is, toward the recording direction. The line width thereof gradually increases toward the same direction.

Further, in the measurement result data, the density and the line width of the line image L14 do not change.

A method of determining whether the target processing liquid nozzle is ejecting the processing liquid is described in detail with reference to FIG. 8.

As measurement result data, the data representing the result of measuring the density and the line width of the line images illustrated in FIG. 7 is used.

First, in Step S21, the determining unit 28 acquires reference pattern data and measurement result data.

Subsequently, in Step S22, the determining unit 28 selects measurement result data of line images as determination targets out of the measurement result data and determines whether the density and the line width of the line images indicated by the measurement result data change in a predetermined direction.

A method of determining whether the density and the line width of the line image indicated by the measurement result data change in the predetermined direction is not particularly limited. The determining unit 28 only has to check whether the density and the line width of the line images change according to the density of the processing liquid deposited on a non-ejection detection target area by the target processing liquid nozzle corresponding to the ink nozzle that records the line image represented by the selected measurement result data of the line image.

Specifically, concerning density and a depositing direction, the determining unit 28 only has to check, using reference pattern data representing a reference image formed by depositing the processing liquid in the same manner as depositing the processing liquid on the non-ejection detection target area of the recording medium, whether changes in density and line width of the line images represented by the measurement result data of the line images coincide with changes in density and line width of a reference image represented by the reference pattern data.

In checking the measurement result data of the line images illustrated in FIG. 7, the determining unit 28 checks, using reference pattern data representing the reference image illustrated in FIG. 4 formed by depositing the ink on an area of the recording medium on which the processing liquid is deposited for ten lines such that the density thereof gradually increases toward the recording direction, whether the measurement result data coincides with changes in density and line width of the reference image represented by the reference pattern data.

As illustrated in FIG. 4, the density of the reference image in this case changes to gradually increase toward the recording direction and the line width thereof changes to gradually decrease toward the recording direction.

For example, when the selected line images are the line images L5, L6, L10, L15, L19, and L23 illustrated in FIG. 7, these line images are images formed by depositing the ink on an area of the recording medium on which the processing liquid is deposited to gradually increase its density toward the recording direction. Therefore, changes in density and line width of the line images coincide with changes in density and line width of the reference image represented by the reference pattern data.

Therefore, in Step S23, the determining unit 28 determines that the target processing liquid nozzle is normally ejecting the processing liquid, determines that the corresponding ink nozzle is normally ejecting the ink, and determines that landing positions of the processing liquid and the ink of the target processing liquid nozzle and the corresponding ink nozzle coincide with each other.

On the other hand, when it is determined in Step S22 that the density and the line width of the line images indicated by the selected measurement result data of the line images do not change in the predetermined direction, in Step S24, the determining unit 28 determines whether the density and the line width of the line images indicated by the selected measurement result data of the line images change in a direction opposite to the predetermined direction.

Specifically, the determining unit 28 only has to check whether the selected line image data does not coincide with the reference pattern data.

For example, when the selected line image is the line image L23 illustrated in FIG. 7, the line image L23 is an image formed by depositing the ink on an area on which the processing liquid is deposited to gradually decrease its density toward the recording direction. Therefore, changes in density and line width of the line image do not coincide with the changes in density and line width of the reference image represented by the reference pattern data.

Therefore, in Step S25, the determining unit 28 determines that it is unknown whether the target processing liquid nozzle is ejecting the processing liquid, determines that a landing position of the ink ejected from the corresponding ink nozzle shifts from a predetermined position (landing position of the processing liquid), and therefore, determines that landing positions of the processing liquid and the ink ejected from the target processing liquid nozzle and the corresponding ink nozzle do not coincide with each other and shift in positions For example, when the selected line image is the line image L14 illustrated in FIG. 7, changes in density and line width of the line image cannot be obtained in the measurement result data of the line image. Therefore, in Step S26, the determining unit 28 determines that the target processing liquid nozzle is a non-ejecting nozzle, determines that the corresponding ink nozzle is a nozzle that is normally ejecting the ink, and determines that a positional relation between landing positions of the processing liquid and the ink ejected from the target processing liquid nozzle and the corresponding ink nozzle is unknown.

After the processing in any one of Steps S23, S25, and S26 is finished, in Step S27, a determination result is recorded in the determination result data.

Thereafter, in Step S28, the determining unit 28 determines whether the selection of measurement result data of all the line images is completed. When the selection of measurement result data is not completed, the determining unit 28 returns to Step S22 and repeats Steps S22 to S28. When the selection of measurement result data is completed, the determining unit 28 finishes the determination concerning whether the target processing liquid nozzle is ejecting the processing liquid.

Though not illustrated in FIG. 7, when a line image is not detected in the linear non-ejection detection target area formed by the target processing liquid nozzle even if the ink is deposited by the corresponding ink nozzle, it is determined that the corresponding ink nozzle is a non-ejecting ink nozzle that is not ejecting the ink and it is determined that it is unknown whether the processing liquid nozzles are not ejecting the processing liquid and correspondence between the processing liquid nozzles and the corresponding ink nozzles is also unknown.

As described above, the detecting device 16 can determine whether the target processing liquid nozzle is ejecting the processing liquid and detect a non-ejecting processing liquid nozzle from a result of the determination.

When a line image such as the line image L23 illustrated in FIG. 7 is detected, it is also possible to generate again a processing liquid deposited pattern in which a linear non-ejection detection target area is formed by the processing liquid nozzle 32 with the number SN24 as the non-ejecting nozzle detection target, form a processing liquid non-ejection detection pattern with the nozzle number of the corresponding ink nozzle 34 changed to IN23 or, conversely, with the nozzle number of the target processing liquid nozzle 32 changed to SN24 while the nozzle number of the corresponding ink nozzle 34 is kept as IN23, calculate a combination of corresponding nozzle numbers of the target processing liquid nozzle 32 and the corresponding ink nozzle 34, and set new association of the processing liquid nozzles and the ink nozzles.

In the first embodiment, it is possible to detect a non-ejecting processing liquid nozzle and a non-ejecting ink nozzle. This makes it possible to detect an image defect due to processing liquid non-ejection and an image defect due to ink non-ejection.

Second Embodiment

A method of detecting a non-ejecting processing liquid nozzle according to a second embodiment of the present invention is described with reference to FIG. 9.

Differences from the first embodiment are mainly described. Explanation of the same components and processing as those in the first embodiment is omitted to simplify explanation.

First, in Step S1, the data acquiring unit 22 acquires reference pattern data and test image data from the image scanning device 14.

As the reference pattern data, the same reference pattern data as that used in the first embodiment only has to be used. The test image data is described in detail later.

Subsequently, in Step S2, the nozzle setting unit 18 sets numbers of the processing liquid nozzles to initial values.

In Step S31, the nozzle setting unit 18 determines a plurality of ink nozzles that deposit an ink on the processing liquid deposited by the target processing liquid nozzle (hereinafter also simply referred to as a plurality of corresponding ink nozzles) and ink nozzles around the corresponding ink nozzles (hereinafter also simply referred to as peripheral ink nozzles).

A method of determining the corresponding ink nozzles is not particularly limited. As an example, there is a method of determining the plurality of corresponding ink nozzles and the peripheral ink nozzles using arrangement data of the processing liquid nozzles and the ink nozzles.

In Step S4, the line detecting unit 24 detects, from the test image data, data of line images (line data) recorded by the plurality of corresponding ink nozzles and the peripheral ink nozzles determined in Step S31.

When line data cannot be detected from the test image data, in Step S32, the line detecting unit 24 determines that the plurality of corresponding ink nozzles and the peripheral ink nozzles are not ejecting the ink, determines that it is unknown whether the target processing liquid nozzle ejected the processing liquid, and determines that a positional relation between a landing position of the processing liquid ejected by the target processing liquid nozzle and landing positions of the ink ejected by the corresponding ink nozzles or the peripheral ink nozzles is unknown.

When line data is detected in Step S4, in Step S6, the line measuring unit 26 measures the density of the line images and the line width of the line images from values of the supplied line data and supplies measurement result data in which a result of the measurement is recorded to the determining unit 28.

Subsequently, in Step S7, the determining unit 28 determines, using the measurement result data supplied from the line measuring unit 26 and the reference pattern data supplied from the data acquiring unit 22, whether the target processing liquid nozzle is ejecting the processing liquid and whether the corresponding ink nozzles and the peripheral ink nozzles are ejecting the ink, and determines update of the corresponding ink nozzles.

A method of determining whether the target processing liquid nozzle is ejecting the processing liquid is described in detail later.

In Step S8, the determining unit 28 records a determination result obtained in Step S32 or S7 in the storing unit 29 as determination result recording data.

In Step S9, the nozzle setting unit 18 checks whether all the processing liquid nozzles are set as target processing liquid nozzles.

When not all the processing liquid nozzles are set as target processing liquid nozzles, in Step S10, the nozzle setting unit 18 increments the number of the target processing liquid nozzle to be set by one. The nozzle setting unit 18 repeats processing of Steps S31 to S9.

When it is determined in Step S9 that all the processing liquid nozzles are set as target processing liquid nozzles, in Step S11, the nozzle setting unit 18 supplies the determination result recording data to the storing unit 29 and finishes the detection of a non-ejecting processing liquid nozzle.

A method of determining whether the target processing liquid nozzle is ejecting the processing liquid is described in detail. This determination is performed by using the measurement result data and the reference pattern data.

The measurement result data is data representing a result obtained by detecting data of a line image (line data) from the test image data and measuring the density and the line width of the detected line image.

Therefore, first, the test image data is described.

The test image data in the second embodiment is digital data representing an image formed by depositing, with the corresponding ink nozzle and the peripheral ink nozzles, the ink on a specific area of a recording medium C on which the processing liquid is deposited in a pattern shape.

A method of generating test image data is not particularly limited. An example of the method is described with reference to FIGS. 10 and 11.

Figure 10:
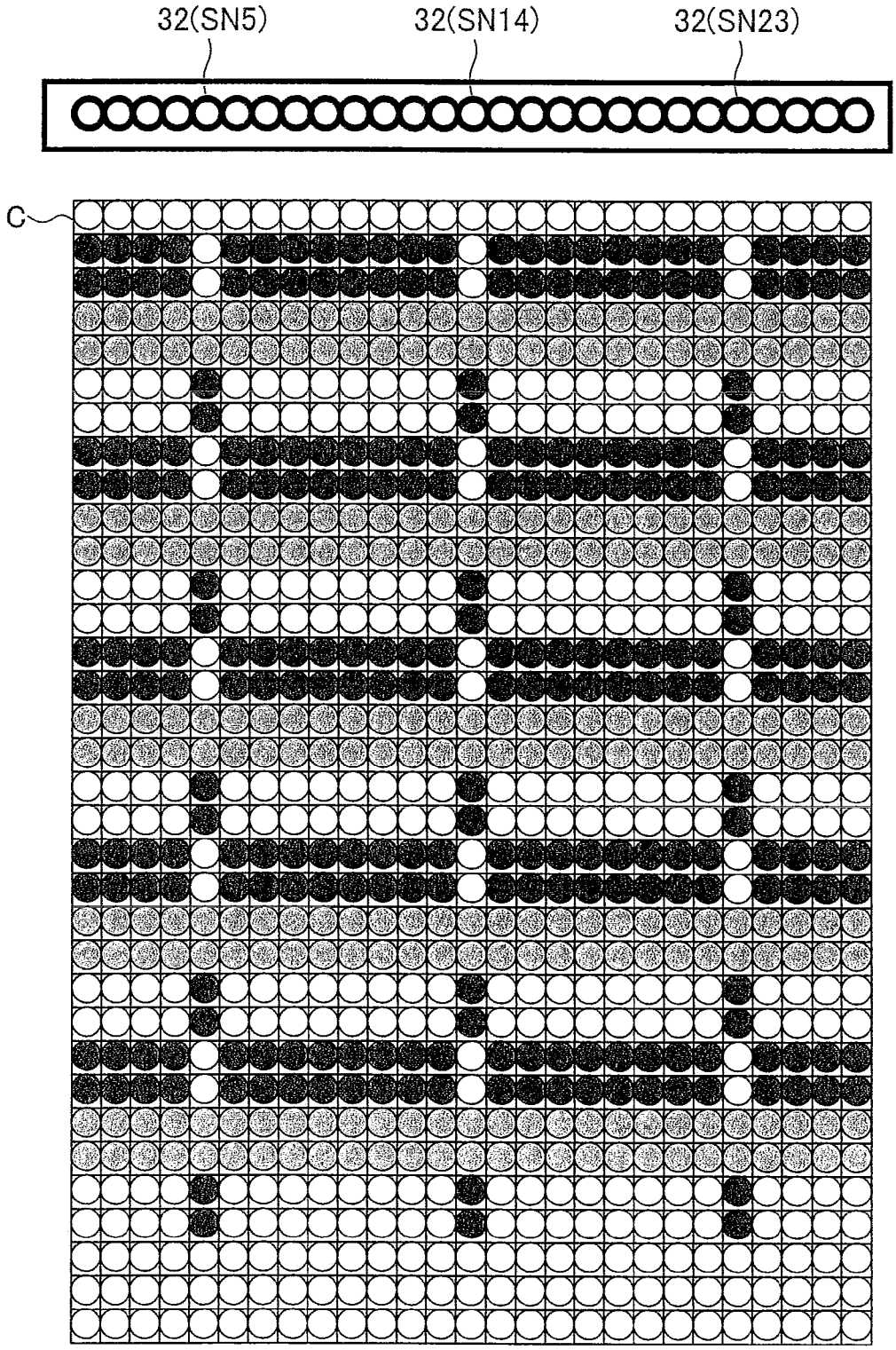
FIG. 10 is a schematic diagram of a recording medium and a processing liquid head in the second embodiment.

FIG. 10 is a schematic diagram of the recording medium C on which the processing liquid is deposited in a specific pattern shape excluding a predetermined area and the processing liquid head 30 including twenty-seven processing liquid nozzles.

The recording medium C illustrated in FIG. 10 is different from the recording medium A illustrated in FIG. 6 in that the same processing liquid deposited pattern is repeatedly formed five times. However, the processing liquid deposited pattern formed on the recording medium C illustrated in FIG. 10 is the same as the processing liquid deposited pattern P1 illustrated in FIG. 6 except that a non-ejection detection target area is formed by six dots. Therefore, detailed explanation of the processing liquid deposited pattern is omitted.

Figure 11:
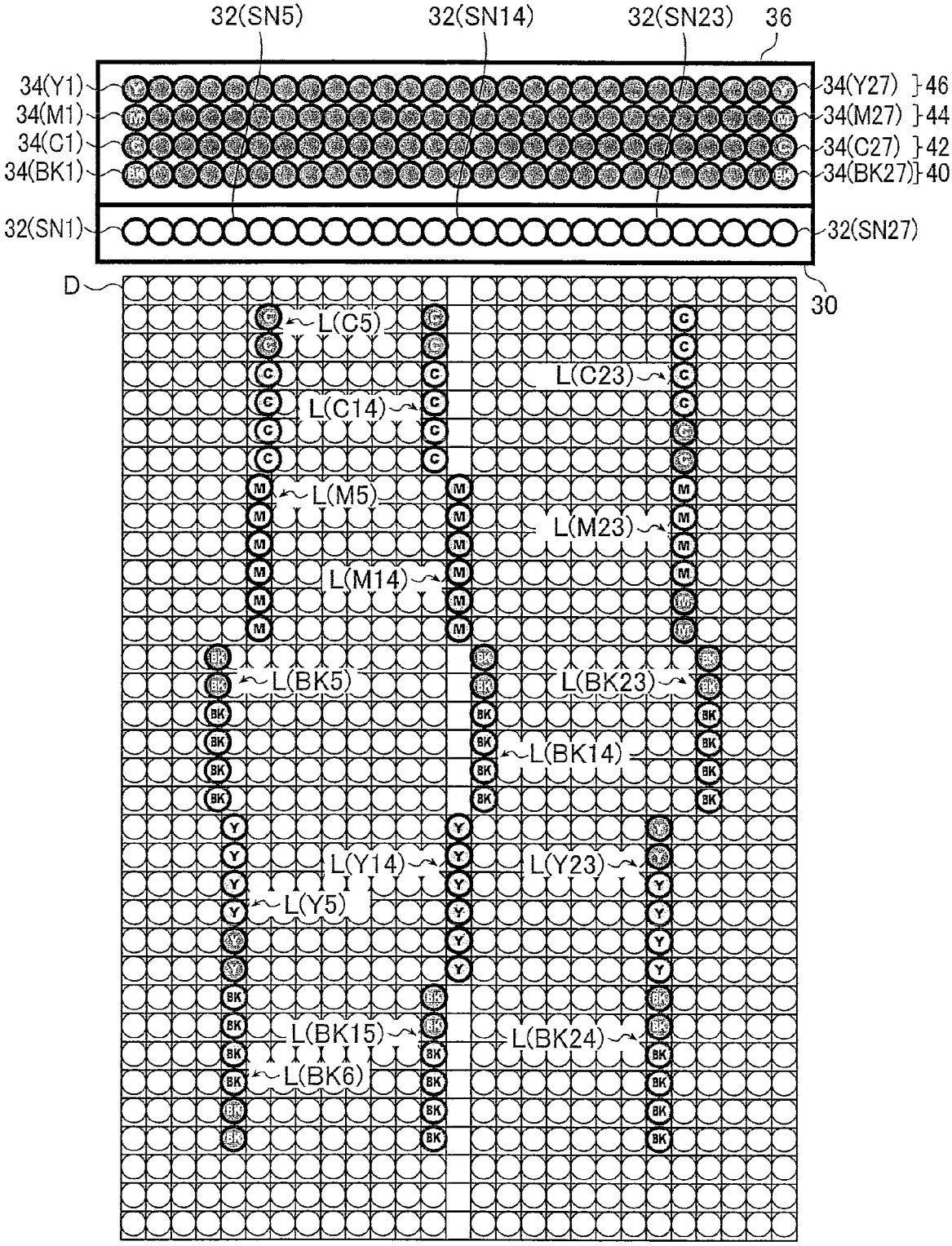
FIG. 11 is a schematic diagram of the recording medium and an ejection head in the second embodiment.

FIG. 11 is a schematic diagram of a recording medium D including a processing liquid non-ejection detection pattern having a line image formed by depositing the ink with the corresponding ink nozzles and the peripheral ink nozzles on a predetermined linear non-ejection detection target area of the recording medium C illustrated in FIG. 10, and the ejection head 38.

The ejection head 38 includes the processing liquid head 30 and the ink head 36.

First, for example, the recording medium C is generated by the image recording unit 12. The recording medium C on which the same processing liquid deposited pattern illustrated in FIG. 10 is repeatedly formed a plurality of times, in the example illustrated in the figure, five times is generated by using the processing liquid head 30.

For example, as illustrated in FIG. 10, when the processing liquid nozzles 32 with the numbers SN5, SN14, and SN23 are set as target processing liquid nozzles, the processing liquid head 30 and the recording medium C are relatively moved and the processing liquid is deposited on every six rows from the second to thirty-second rows by the processing liquid nozzles 32 with the numbers SN5, SN14, and SN23 of the processing liquid head 30 such that the density of the processing liquid gradually increases. In this way, the recording medium C on which five identical processing liquid deposited patterns, in which linear non-ejection detection target areas are formed, are formed is generated.

Subsequently, the ink is deposited on a predetermined area of the recording medium C illustrated in FIG. 10 by the corresponding ink nozzle and the peripheral ink nozzles to form a line image. The recording medium D having the line image is generated.

As illustrated in FIG. 11, the ink head 36 has nozzle lines, in which the twenty-seven ink nozzles 34 are linearly arranged, in order of black (BK), cyan (C), magenta (M), and yellow (Y) from the bottom of FIG. 11.

Numbers of the ink nozzles 34 in a black nozzle line 40 are BK1, BK2, . . . , and BK27 from the left of FIG. 11. Numbers of the ink nozzles 34 in a cyan nozzle line 42 are C1, C2, . . . , and C27 from the left of FIG. 11. Numbers of the ink nozzles 34 in a magenta nozzle line 44 are M1, M2, . . . , and M27 from the left of FIG. 11. Numbers of the ink nozzles 34 in a yellow nozzle line 46 are Y1, Y2, . . . , and Y27 from the left of FIG. 11.

When such an ink head 36 as described above is used, for example, if the target processing liquid nozzle 32 is the processing liquid nozzle 32 (SN5), the corresponding ink nozzles 34 are the ink nozzles 34 (BK5, C5, M5, and Y5) and the peripheral ink nozzle is, for example, the ink nozzle (BK6). If the target processing liquid nozzle 32 is the target processing liquid nozzle 32 (SN14), the corresponding ink nozzles 34 are the ink nozzles 34 (BK14, C14, M14, and Y14). The peripheral ink nozzle is, for example, the ink nozzle (BK15). If the target processing liquid nozzle 32 is the processing liquid nozzle 32 (SN23), the corresponding ink nozzles 34 are the ink nozzles 34 (BK23, C23, M23, and Y23). The peripheral ink nozzle is, for example, the ink nozzle (BK24).

The ink nozzles 34 (C5, C14 and C23) deposit the ink only on the second to seventh rows of the recording medium C. The ink nozzles 34 (M5, M14 and M23) deposit the ink only on the eighth to thirteenth rows of the recording medium C. The ink nozzle 34 (BK5) deposits the ink only on the fourteenth to nineteenth rows of the recording medium C. The ink nozzles 34 (Y5, Y14 and Y23) deposit the ink only on the twentieth to twenty-fifth rows of the recording medium C. The ink nozzles 34 (BK6, BK14 and BK24) deposit the ink only on the twenty-sixth to thirty-first rows of the recording medium C. In this way, the ink nozzles 34 form line images to generate the recording medium D having those line images.

A line image recorded by the ink nozzle 34 (C5) is represented as L(C5). A line image recorded by the ink nozzle (Y14) is represented as L(Y14). A line image recorded by the ink nozzle (BK24) is represented as L(BK24).

Such a recording medium D as described above is scanned by the image scanning device 14 and converted into digital data to generate test image data.

In order to generate measurement result data, data of the line images (line data) is detected from the test image data.

Image data representing line images L(C5, M5, BK5, Y5, BK6, C14, M14, BK14, Y14, BK15, C23, M23, BK23, Y23, and BK24) illustrated in FIG. 11 is detected from the test image data.

The line images L(M14 and Y14) among the line images represented by the detected line image data are line images recorded by depositing the ink on an area on which the processing liquid is not deposited at all.

The line images L(Y5, BK6, Y23, and BK24) are images in which the density thereof gradually increases and the line width thereof gradually decreases toward the recording direction according to a change in the density of the processing liquid in the non-ejection detection target area.

The line images L(C5, BK5, C14, BK14, BK15, C23, M23, and BK23) are images in which, because landing positions of the ink change, the density thereof gradually decreases and the line width of thereof gradually increases toward the recording direction against a change in the density of the processing liquid in the non-ejection detection target area.

The line image L(M5) is an image recorded by the ink nozzle 34 (M5) without depositing the ink.

After the data of the line images (line data) are detected, the density and the line width of the line images represented by the data are measured and a result of the measurement is recorded to generate measurement result data.

In measurement result data of the line images L(Y5, BK6, Y23, and BK24), a value representing the density of the images gradually increases and a value representing the line width of the images gradually decreases toward the recording direction on the recording medium.

In measurement result data of the line images L(C5, BK5, C14, BK14, BK15, C23, M23, and BK23), a value representing the density of the images gradually decreases and a value representing the line width of the images gradually increases toward the recording direction on the recording medium.

In measurement result data of the line images L(M14 and LY14), values representing the density and the line width of the line image do not change at all.

In measurement result data of the line image L(M5), values representing the density and the line width of the line image cannot be obtained.

Figure 12:
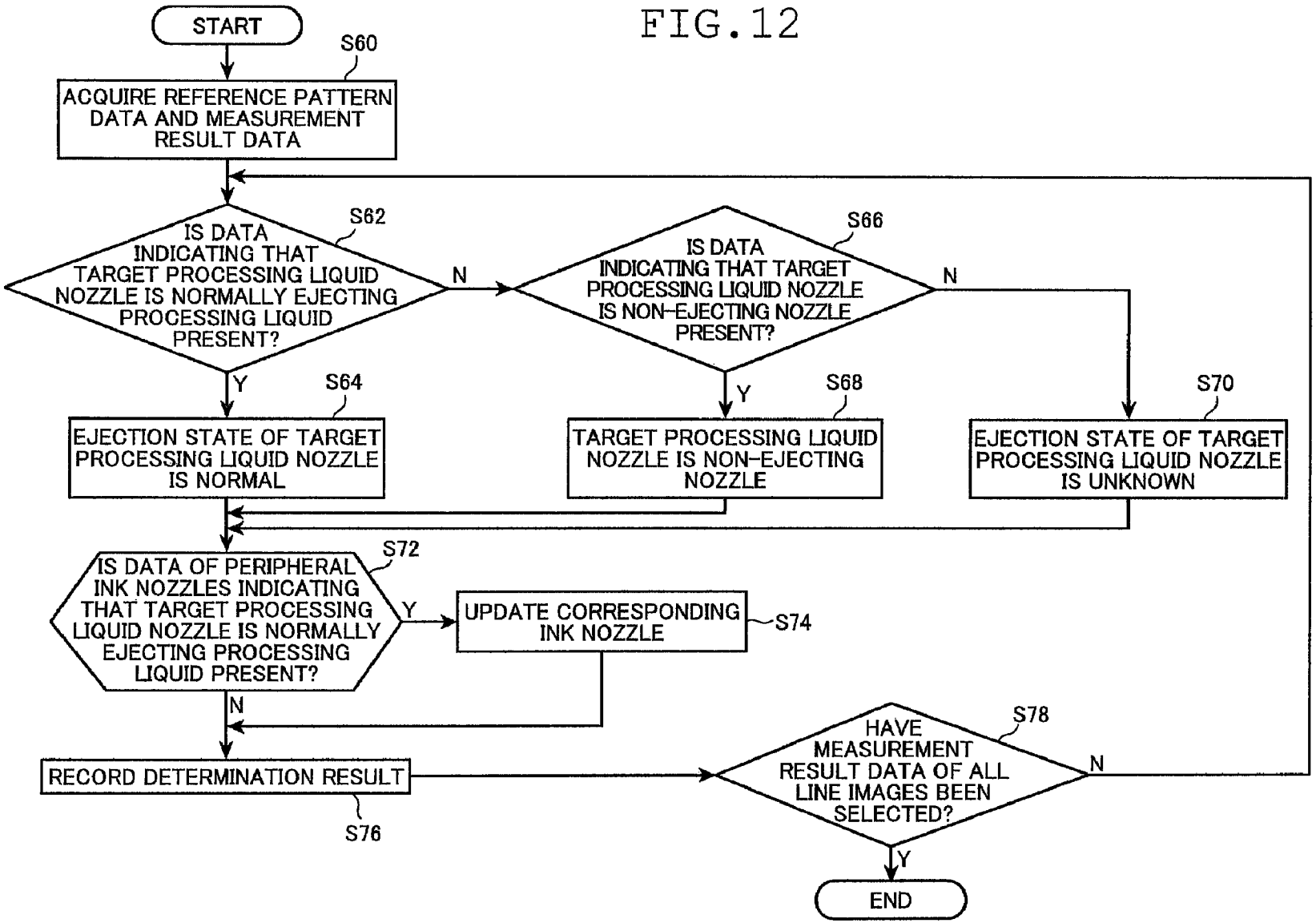
FIG. 12 is a flowchart of a method of determining whether one target processing liquid nozzle is ejecting processing liquid in the second embodiment.

A method of determining an ejection state of each of the target processing liquid nozzles of the second embodiment is described with reference to FIG. 12.

First, in Step S60, the determining unit 28 acquires reference pattern data and measurement result data.

Subsequently, in Step S62, the determining unit 28 determines, using the reference pattern data, whether data indicating that the target processing liquid nozzle 32 is normally ejecting the processing liquid is present in the measurement result data of the line images recorded in association with the target processing liquid nozzle 32.

When it is determined as a result of the determination that relevant data is present, in Step S64, the determining unit 28 determines that the target processing liquid nozzle 32 is normally ejecting the processing liquid.

On the other hand, when it is determined in Step S62 that relevant data is not present, the determining unit 28 determines, using the reference pattern data, whether data indicating that the target processing liquid nozzle is a non-ejecting nozzle is present in the selected measurement result data of the line image.

When it is determined as a result of the determination that relevant data is present, in Step S68, the determining unit 28 determines that the target processing liquid nozzle is a non-ejecting nozzle.

On the other hand, when it is determined in Step S66 that there is no relevant data, in Step S70, the determining unit 28 determines that an ejection state of the target processing liquid nozzle is unknown.

After Steps S64, 68, or 70, in Step S72, the determining unit 28 determines whether data of the peripheral ink nozzles indicating that the target processing liquid nozzle is normally ejecting the processing liquid is present in the selected measurement result data of the line image.

When it is determined as a result of the determination that relevant data is present, in Step S74, the determining unit 28 updates an ink nozzle corresponding to the target processing liquid nozzle. In other words, the determining unit 28 sets a peripheral ink nozzle that records the data determined in Step S72 as a new corresponding ink nozzle.

On the other hand, when it is determined in Step S72 that relevant data is not present, in Step S76, the determining unit 28 records a determination result in Step S64, S68, or S70 and a processing result in Step S74 in the determination result recording data.

Thereafter, in Step S78, the determining unit 28 determines whether measurement result data of all the line images are selected.

When measurement result data of line images that should be selected still remain, the determining unit 28 returns to Step S62 and repeats Steps S62 to S78. On the other hand, when it is determined in Step S78 that measurement result data of all the line images are selected, the determining unit 28 finishes detection of the non-ejecting processing liquid nozzle.

A method of determining an ejection state of each of the target processing liquid nozzles at the time when data obtained by measuring the density and the line width of the line image illustrated in FIG. 11 is used as measurement result data is specifically described. As reference pattern data, data formed by depositing the ink on an area on which the processing liquid for six dots is deposited such that the density of the processing liquid gradually increases in the recording direction as in the non-ejection detection target area illustrated in FIG. 10 is used.

For example, after acquiring the reference pattern data and the measurement result data in Step S60, the determining unit 28 selects measurement result data of line images recorded in association with the target processing liquid nozzle 32 (SN5), that is, measurement result data of the line images L(C5, M5, BK5, Y5, and BK6). In Step S62, the determining unit 28 determines whether data indicating that the target processing liquid nozzle 32 is normally ejecting the processing liquid is present in the selected data.

In this case, the determining unit 28 only has to check whether changes in values of the density and the line width of the selected measurement result data coincide with a change in a value of the line width of the reference pattern data.

Measurement result data of the line images L(Y5 and BK6) formed by depositing the ink on an area on which the processing liquid is deposited such that the density of the processing liquid increases in the recording direction is present in the selected measurement result data. Therefore, in Step S64, the determining unit 28 can determine that the target processing liquid nozzle 32 (SN5) is normally ejecting the processing liquid.

The determining unit 28 can also determine that the ink nozzle 34 (M5) is a non-ejecting ink nozzle from a result of this determination result and the measurement result data of the line image L(M5) in which changes in values of the density and the width thereof are not obtained.

Subsequently, in Step S72, the determining unit 28 checks whether measurement result data of line images recorded by the peripheral ink nozzles indicating that the target processing liquid nozzle is normally ejecting the processing liquid is present in the selected measurement result data.

In this case, the determining unit 28 only has to check whether changes in values of the density and the line width of images represented by measurement result data of line images of the peripheral ink nozzles, which are not expected to deposit the ink on a position on which the target processing liquid nozzles 32 deposited the processing liquid, coincide with changes in values of the density and the line width of images represented by the reference pattern data.

Measurement result data of the line image L(BK6) of the peripheral ink nozzles coinciding with the changes in the values of the density and the line width of the image represented by the reference pattern data is present in the selected measurement result data. Therefore, in Step S74, the determining unit 28 updates the black ink nozzle 34 corresponding to the target processing liquid nozzle (SN5) to the ink nozzle 34 (BK6).

In Step S76, the determining unit 28 records the determination results obtained in Step S64 and Step S74 in the determination result recording data. In Step S78, the determining unit 28 determines whether measurement result data of all the line images are selected. Then, it is confirmed that other measurement result data of line images not selected yet are present.

Therefore, the determining unit 28 selects, for example, measurement result data of line images recorded in association with the target processing liquid nozzle (SN23), that is, measurement result data of the line images L(C23, M23, BK23, Y23, and BK24). In Step S62, the determining unit 28 determines whether data indicating that the target processing liquid nozzle is normally ejecting the processing liquid is present in the selected measurement result data.

In this case, measurement result data of the line image L(Y23 and BK24) coinciding with the changes in the values of the density and the line width of an image represented by the reference pattern data is present in the selected measurement result data. Therefore, in Step S64, the determining unit 28 can determine that the target processing liquid nozzle (SN23) is normally ejecting the processing liquid.

In Step S72, the determining unit 28 determines whether measurement result data of a line image recorded by the peripheral ink nozzles indicating that the target processing liquid nozzle is normally ejecting the processing liquid is present in the selected measurement result data.

Relevant line image data cannot be confirmed in the selected measurement result data, and hence, in Step S76, the determining unit 28 records the determination result obtained in Step S64 in the determination result data. In Step S78, the determining unit 28 determines whether measurement result data of all the line images are selected.

As a result, it is confirmed that measurement result data of a line image not selected yet is present.

Therefore, for example, the determining unit 28 selects measurement result data of line images recorded in association with the target processing liquid nozzle (SN14), that is, measurement result data of the line images L(C14, M14, BK14, Y14, and BK15). In Step S62, the determining unit 28 determines whether data indicating that the target processing liquid nozzle is normally ejecting the processing liquid is present in the measurement result data.

The data indicating that the target processing liquid nozzle is normally ejecting the processing liquid is not present in the selected measurement result data. Therefore, in Step S66, the determining unit 28 determines whether data indicating that the target processing liquid nozzle is a non-ejecting nozzle is present.

Measurement result data of the line images (C14, BK14, and BK15) opposite to the changes in the density and the line width of the image represented by the reference pattern data is present in the selected line image data. Therefore, in Step S68, the determining unit 28 determines that the target processing liquid nozzle (SN14) is a non-ejecting nozzle.

In Step S72, the determining unit 28 determines whether measurement result data of a line image recorded by the peripheral ink nozzles indicating that the target processing liquid nozzle is normally ejecting the processing liquid is present in the selected measurement result data.

Relevant line image data is not confirmed in the selected measurement result data, and hence, in Step S76, the determining unit 28 records the determination result obtained in Step S68 in the determination result data. In Step S78, the determining unit 28 determines whether measurement result data of all the line images are selected.

As a result, there is not other unselected measurement result data of line images, and hence the determining unit 28 finishes the determination concerning whether the target processing liquid nozzle is ejecting the processing liquid.

In this way, it is possible to detect the non-ejecting processing liquid nozzle and the non-ejecting ink nozzle. This makes it possible to detect an image defect due to processing liquid non-ejection and an image defect due to ink non-ejection.

Further, it is possible to simultaneously determine ink nozzles to be associated with the target processing liquid nozzle anew according to a landing position of the ink of the ink nozzles and associate the ink nozzles in addition to detecting the non-ejecting processing liquid nozzle and the non-ejecting ink nozzle.

Third Embodiment

A method of detecting a non-ejecting processing liquid nozzle according to a third embodiment of the present invention is described below.

Figure 3:
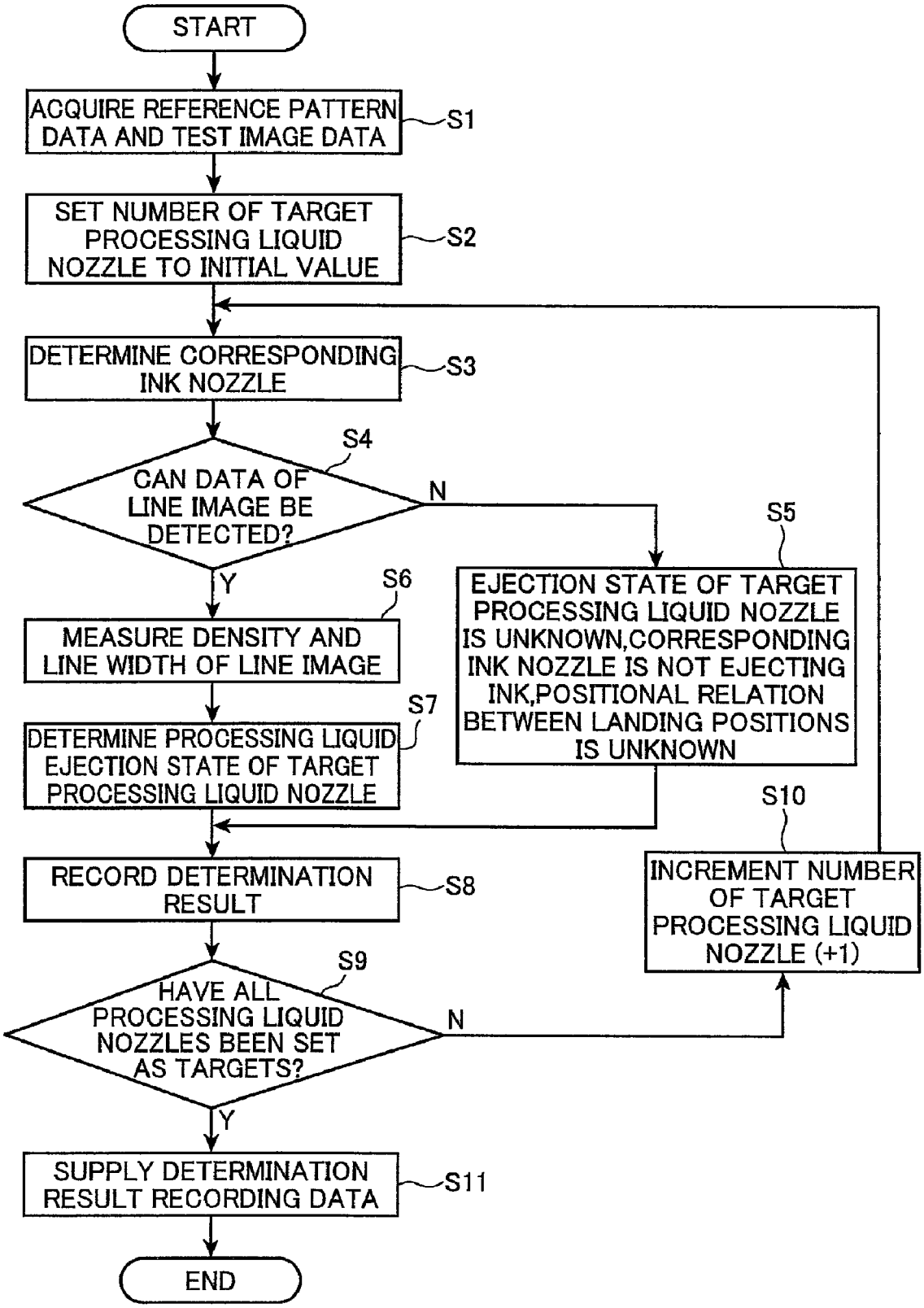
FIG. 3 is a flowchart of a method of detecting a non-ejecting processing liquid nozzle according to the first embodiment.

An overall flow of the method of detecting a non-ejecting processing liquid nozzle according to the third embodiment is the same as the flow of the first embodiment illustrated in FIG. 3.

Reference pattern data and measurement result data of the third embodiment are described below.

The reference pattern data is used to determine whether a target processing liquid nozzle is ejecting processing liquid. The reference pattern data is data of an image having, as reference images, a processed image obtained by depositing an ink on an area on which the processing liquid is deposited and processing (fixing) the ink with the processing liquid (hereinafter also referred to as normal image or fixed image) and an image obtained by depositing the ink on an area without the processing liquid and not processing (fixing) the ink with the processing liquid (hereinafter also referred to as unprocessed image or unfixed image).

The normal image and the unprocessed image as the reference images are described with reference to FIGS. 13A and 13B.

Figure 13A:
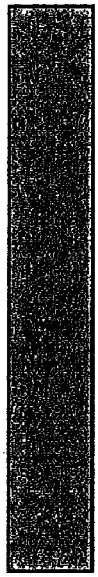
FIG. 13A is a schematic diagram of a normal image.

FIG. 13A is a schematic diagram of the normal image. FIG. 13B is a schematic diagram of a reference image having both the normal image and the unprocessed image.

The processing liquid has an action of agglomerating and fixing color materials of colored inks on a recording medium. Therefore, for example, if the ink is deposited by one ink nozzle to form the normal image on the recording medium on which the processing liquid is deposited, a line image illustrated in FIG. 13A can be drawn.

Figure 13B:
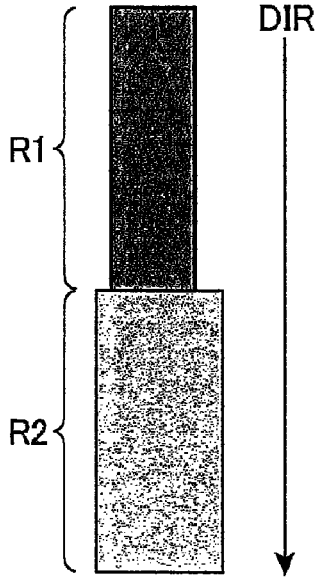
FIG. 13B is a schematic diagram of a reference image used in a third embodiment of the present invention.

On the other hand, for example, as illustrated in FIG. 13B, an image is formed by depositing the ink with one ink nozzle in an arrow direction of FIG. 13B in a linear non-ejection detection target area in which a processing liquid deposited area on which the processing liquid is deposited (area on which the processing liquid is continuously deposited a predetermined number of dots) and a processing liquid non-deposited area on which the processing liquid is not deposited (area on which the processing liquid is not continuously deposited the predetermined number of dots) are adjacent to each other. Then, a line image in an upper area (processing liquid deposited area) on which the processing liquid is deposited forms a normal image same as that of FIG. 13A. A line image in a lower area (processing liquid non-deposited area) R2 on which the processing liquid is not deposited forms an image having lower density and larger width compared with the normal image (hereinafter also referred to as unprocessed image).

Changes in the density and the line width of the normal image and the unprocessed image are described with reference to FIG. 14.

Figure 14:
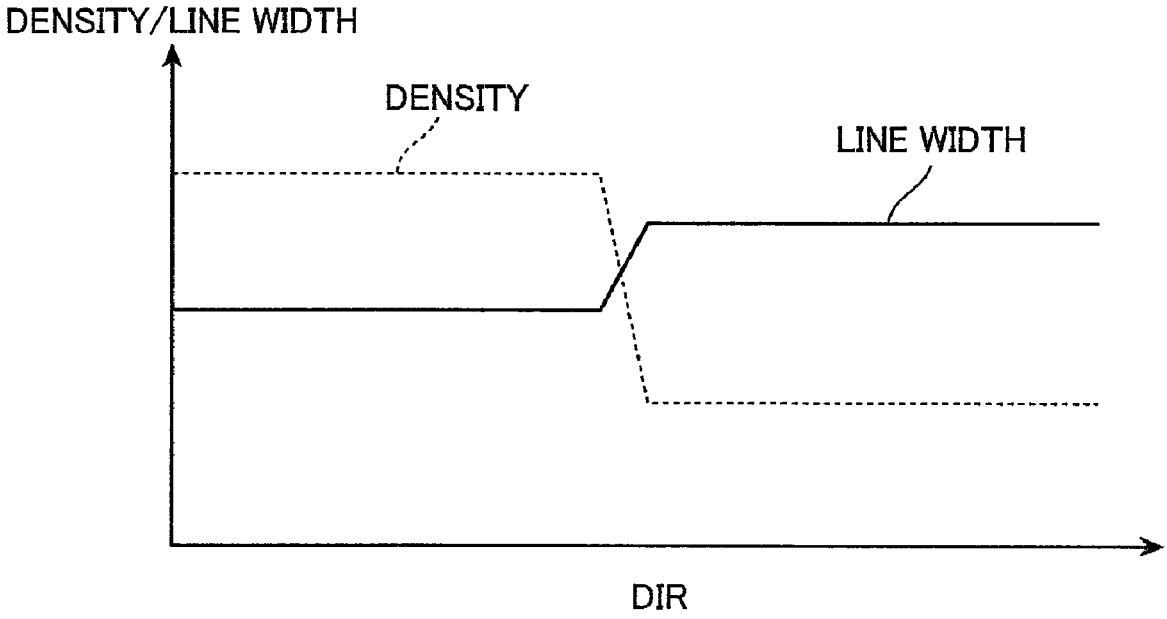
FIG. 14 is a graph of changes in density and line width of the reference image used in the third embodiment.

A dotted line of FIG. 14 indicates a change in the density in the arrow direction of the image illustrated in FIG. 13B. A solid line of FIG. 14 indicates a change in the line width in the arrow direction of the image illustrated in FIG. 13B.

As illustrated in FIG. 14, the density of the line image is substantially different between the normal image and the unprocessed image. The density of the unprocessed image is lower compared with the density of the normal image. The line width of the line image is also substantially different between the normal image and the unprocessed image. The line width of the unprocessed image is larger compared with the line width of the normal image.

This is because, if the ink is deposited on an area on which the processing liquid is not deposited, the ink is not fixed and tends to blur.

A method of generating reference data pattern is not specifically limited. As an example, there is a method of, by the recording unit 12, depositing the ink on a recording medium, which has an area on which the processing liquid is not deposited and an area on which the processing liquid is deposited, in a conveying direction of the recording medium and recording the line image having the normal image and the unprocessed image illustrated in FIG. 13B and, by the image scanning device 14, scanning this line image and converting data of the scanned line image into digital data to generate reference pattern data.

Measurement result data is described below.

The measurement result data is data representing a result obtained by detecting image data of the line image (line data) from the test image data and measuring the density and the line width of the detected line image.

Therefore, first, the test image data is described.

In the third embodiment, the test image data is digital data representing an image including a line image formed by depositing colored inks, with ink nozzles corresponding to the target processing liquid nozzle, on a recording medium on which a processing liquid deposited pattern having a predetermined area on which the processing liquid is not deposited (processing liquid non-deposited area) and a predetermined area on which the processing liquid is deposited (processing liquid deposited area) is formed in a processing liquid deposited line deposited by only the target processing liquid nozzle.

A method of generating test image data is not specifically limited. An example of the method is described with reference to FIGS. 15 and 16.

Figure 15:
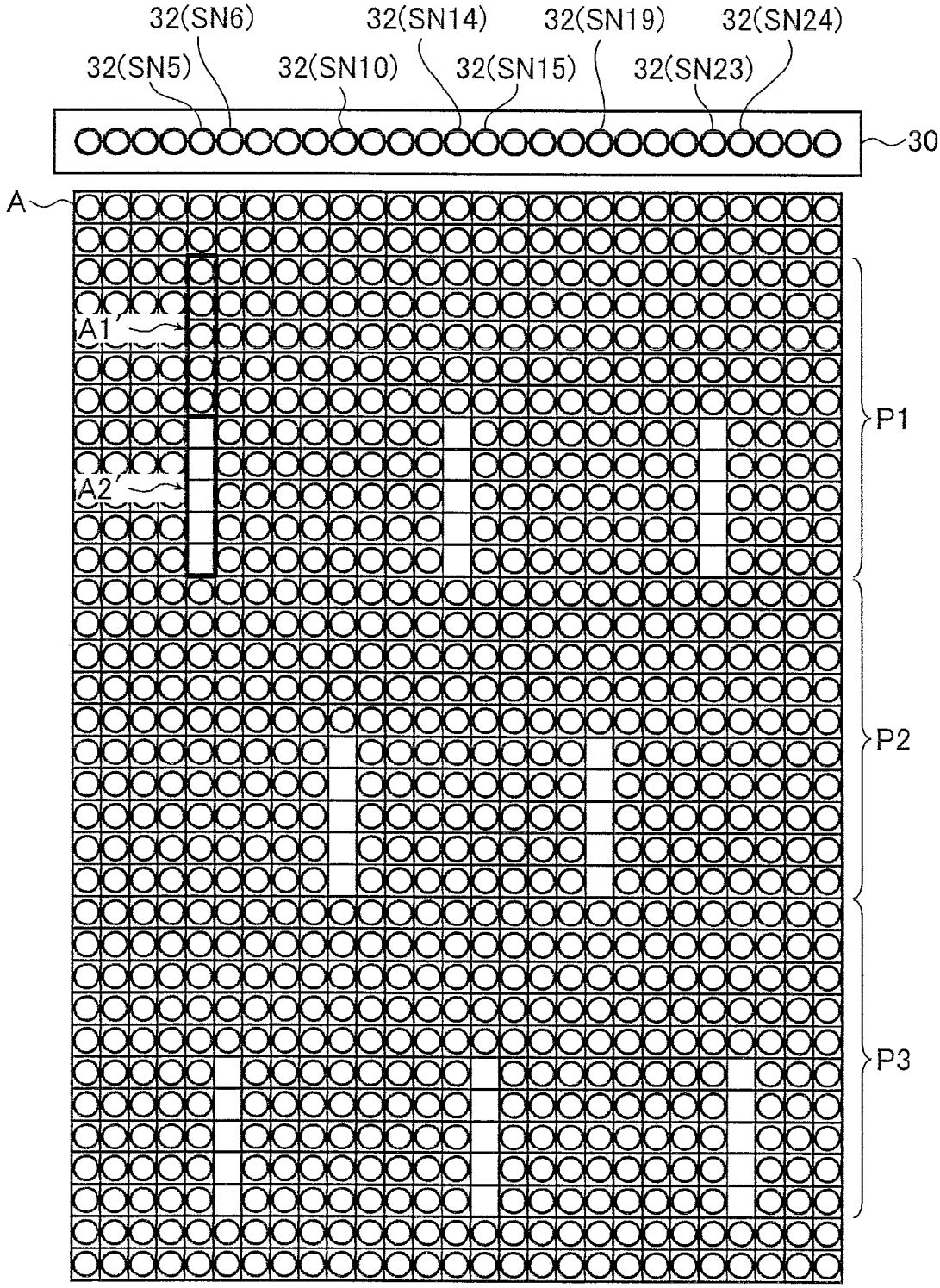
FIG. 15 is a schematic diagram of a recording medium and a processing liquid head in the third embodiment.

FIG. 15 is a schematic explanatory diagram of the recording medium A on which three kinds of processing liquid deposited patterns (P1, P2, and P3) are formed and the processing liquid ejection head 30 including twenty-seven processing liquid nozzles 32. In the processing liquid patterns, a linear non-ejection detection target area in which the processing liquid deposited area and the processing liquid non-deposited area are continuous is formed only in a processing liquid deposited line formed by the processing target liquid nozzle.

Figure 16:
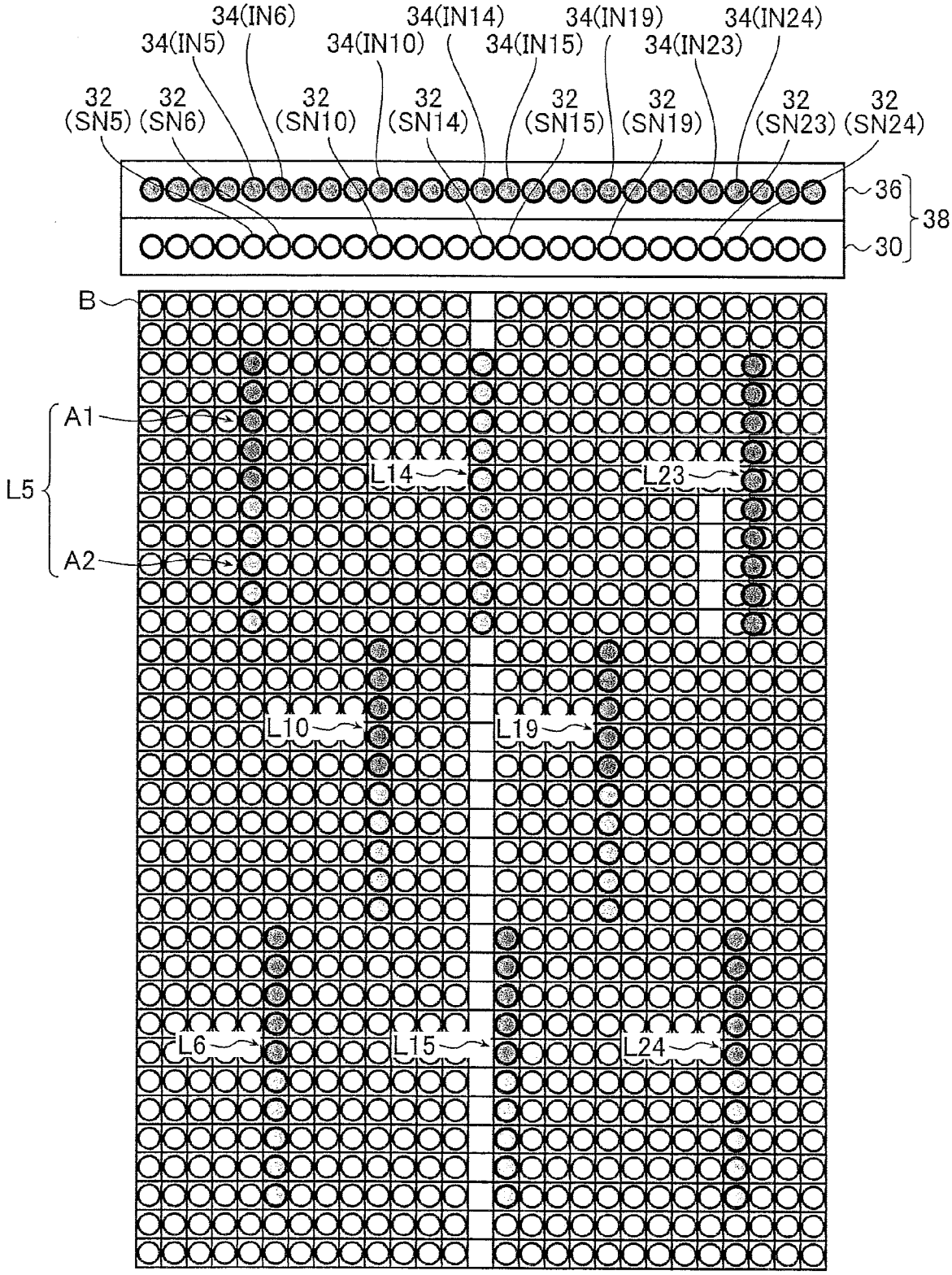
FIG. 16 is a schematic diagram of the recording medium and an ejection head in the third embodiment.

FIG. 16 is a schematic diagram of the recording medium B on which a processing liquid non-ejection detection pattern having a line image formed by depositing colored inks with corresponding ink nozzles corresponding to the target processing liquid nozzles on the recording medium A illustrated in FIG. 15 is formed and the ejection head 38.

The processing liquid non-ejection detection pattern illustrated in FIG. 16 indicates an example of an image represented by the test image data.

First, the image recording unit 12 deposits the processing liquid with the processing liquid nozzles 32 of the processing liquid head 30 to generate the recording medium A on which the processing liquid deposited pattern including the linear landing position determination target areas illustrated in FIG. 15 is formed.

In the processing liquid head 30, as illustrated in FIG. 15, twenty-seven processing liquid nozzles 32 (SN1, SN2, . . . , and SN27 from the left) are arranged in line in a lateral direction of FIG. 15.

The width in the lateral direction of FIG. 15 (hereinafter, referred to as row direction) of the recording medium A illustrated in FIG. 15 coincides with the length of twenty-seven processing liquid dots in a row deposited by the twenty-seven processing liquid nozzles 32 arrayed in a row. The length in a longitudinal direction of FIG. 15 (hereinafter, referred to as column direction) of the recording medium A coincides with the length of thirty-four processing liquid dots in a column deposited thirty-four times by one processing liquid nozzle 32.

In other words, it is possible to coat the entire surface of the recording medium A with the processing liquid by ejecting the processing liquid for thirty-four columns with the twenty-seven processing liquid nozzles in total of the processing liquid head 30.

The recording medium A on which the processing liquid deposited pattern including the plurality of linear non-ejection detection target areas is generated by using the recording medium A and the processing liquid nozzles 32 described above.

For example, when the processing liquid nozzles 32 with the numbers SN5, SN6, SN10, SN14, SN15, SN19, SN23, and SN24 are set as target processing liquid nozzles, the processing liquid nozzles 32 with the numbers of SN5, SN14, and SN23 are set not to eject the processing liquid on only the eighth to twelfth rows of the recording medium A, the processing liquid nozzles 32 with the numbers SN10 and SN19 are set not to eject the processing liquid on only the eighteenth to twenty-second rows of the recording medium A, and the processing liquid nozzles 32 with the numbers SN6, SN15, and SN24 are set not to eject the processing liquid on only the twenty-eighth to thirty-second rows of the recording medium A. The other processing liquid nozzles are set to eject the processing liquid on all the rows (first to thirty-fourth rows). The processing liquid deposited pattern having the processing liquid non-deposited area is formed on the recording medium A by relatively moving the processing liquid head 30 and the recording medium A.

In this way, on the recording medium A illustrated in FIG. 15, the processing liquid deposited pattern P1 having a linear non-ejection detection target area in which a processing liquid deposited area (third to seventh rows) A1' and a processing liquid non-deposited area (eighth to twelfth rows) A2' continue is formed in the third to twelfth rows of a processing liquid deposited line formed by the processing liquid nozzles 32 having the numbers SN5, SN14, and SN23. The processing liquid deposited pattern P2 having a linear non-ejection detection target area in which a processing liquid deposited area (thirteenth to seventeenth rows) and a processing liquid non-deposited area (eighteenth to twenty-second rows) continue is formed in the thirteenth to twenty-second rows of a processing liquid deposited line formed by the processing liquid nozzles 32 having the numbers SN10 and SN19. Further, the processing liquid deposited pattern P3 having a linear non-ejection detection target area in which a processing liquid deposited area (twenty-third to twenty-seventh rows) and a processing liquid non-deposited area (twenty-eighth to thirty-second rows) continue is formed in the twenty-third to thirty-second rows of a processing liquid deposited line formed by the processing liquid nozzles 32 having the numbers SN6, SN15, and SN24.

Subsequently, the ink is deposited on the recording medium A illustrated in FIG. 15, on which the three kinds of processing liquid deposited patterns P1 to P3 are formed, by the corresponding ink nozzles 34 of the target processing liquid nozzles 32 having the numbers SN5, SN6, SN10, SN14, SN15, SN19, SN23, and SN24 to form a line image and the recording medium B on which a processing liquid non-ejection detection pattern having this line image is formed is generated. In this case, as in the above-mentioned case, the corresponding ink nozzles 34 corresponding to the target processing liquid nozzles 32 deposit the ink only on the portion of the processing liquid deposited patterns in which the target processing liquid nozzles 32 form the linear non-ejection detection target areas rather than deposit the ink on all the first to thirty-fourth rows.

As illustrated in FIG. 16, it is assumed that, in the ink head 36, twenty-seven ink nozzles 34 having the same size as that of the processing liquid head 32 are arranged in a row in the lateral direction (row direction) of FIG. 16.

The ejection head 38 includes the processing liquid head 30 and the ink head 36.

For example, as illustrated in FIG. 16, when the corresponding ink nozzles 34 corresponding to the target processing liquid nozzles with the numbers SN5, SN6, SN10, SN14, SN15, SN19, SN23, and SN24 are the ink nozzles 34 with the numbers IN5, IN6, IN10, IN14, IN15, IN19, IN23, and IN24, the respective ink nozzles 34 deposit the ink on a linear non-ejection detection target area, in which the processing liquid deposited area A1' and the processing liquid non-deposited area A2' continue, of the recording medium A illustrated in FIG. 15. The ink nozzles 34 with the numbers IN5, IN14, and IN23 deposit the ink on the third to twelfth rows, the ink nozzle 34 with the numbers IN10 and IN19 deposit the ink on the thirteenth to twenty-second rows, and the ink nozzles 34 with the numbers IN6, IN15, and IN24 deposit the ink on the twenty-third to thirty-second rows to form the line images (L5, L6, L10, L14, L15, L19, L23, and L24) and generate the recording medium B on which the processing liquid non-ejection detection pattern having those line images.

The recording medium B having such line images is scanned by the image scanning device 14 and converted into digital data to generate test image data.

In order to generate measurement result data, line data is detected from such test image data.

In this example, only image data representing the line images L5, L6, L10, L14, L15, L19, L23, and L24 is detected from the data of the processing liquid non-ejection detection pattern illustrated in FIG. 16.

The line images L5, L6, L10, L15, L19, and L24 among the detected line images have a fixed normal image area A1 which has the predetermined density and width because the deposited processing liquid and the deposited ink overlap each other and an unfixed unprocessed image area A2 which cannot have the predetermined density and width because the ink and the processing liquid do not overlap each other.

In general, as described above, the unprocessed image area A2 has lower density and larger line width compared with the normal image area A1.

Among the detected line images, line images not having changing points of density and width are the line images L14 and L23.

As illustrated in FIG. 16, the line image L14 is a line image recorded by depositing the ink on an area on which the processing liquid is not deposited at all. On the other hand, the line image L23 is a line image recorded by depositing the ink on an area on which the processing liquid is deposited.

In general, the line image L14 has lower density and larger width compared with the line image L23.

In FIG. 16, to prevent complication of the figure, the symbols indicating the unprocessed image area A2 and the normal image area A1 are not affixed to the line images L6, L10, L15, L19, and L24, but the line images are the same as the line image L15. In the example illustrated in FIG. 16, the width of the line image in the unprocessed image area A2 and the width of the line image in the normal image area A1 are substantially the same. However, actually, the width of the line image in the unprocessed image area A2 is larger than the width of the line image in the normal image area A1.

The predetermined density in this case is the density of a line image formed when landing positions of the processing liquid and the ink coincide with each other. On the other hand, the predetermined width is the line width of the line image formed when landing positions of the processing liquid and the ink coincide with each other.

After the data of the line images L5, L6, L10, L14, L15, L19, L23, and L24 are detected, the density and the width of the line images are measured to generate measurement result data.

In the measurement result data, values of the density and the line width of the line images L5, L6, L10, L15, L19, and L24 having the normal image area A1 and the unprocessed image area A2 described above substantially change in a boundary between the normal image area A1 and the unprocessed image area A2.

In the measurement result data, the density of the line image L14 does not change in the line image, that is, does not change from the predetermined density and has a value equal to or smaller than a reference value. The line width of the line image L14 does not also change in the line image, that is, does not change from the predetermined line width and has a value equal to or larger than a reference value.

The density of the line image L23 does not change in the line image, that is, does not change from the predetermined density and has a value substantially equal to the reference value. The line width of the line image L23 does not change in the line image, that is, does not change from the predetermined line width and has a value substantially equal to the reference value.

The reference value of density represents the density of a line image formed when the processing liquid and the ink overlap each other on the recording medium. The reference value of line width represents the line width of the line image formed when the processing liquid and the ink overlap each other on the recording medium.

Figure 17:
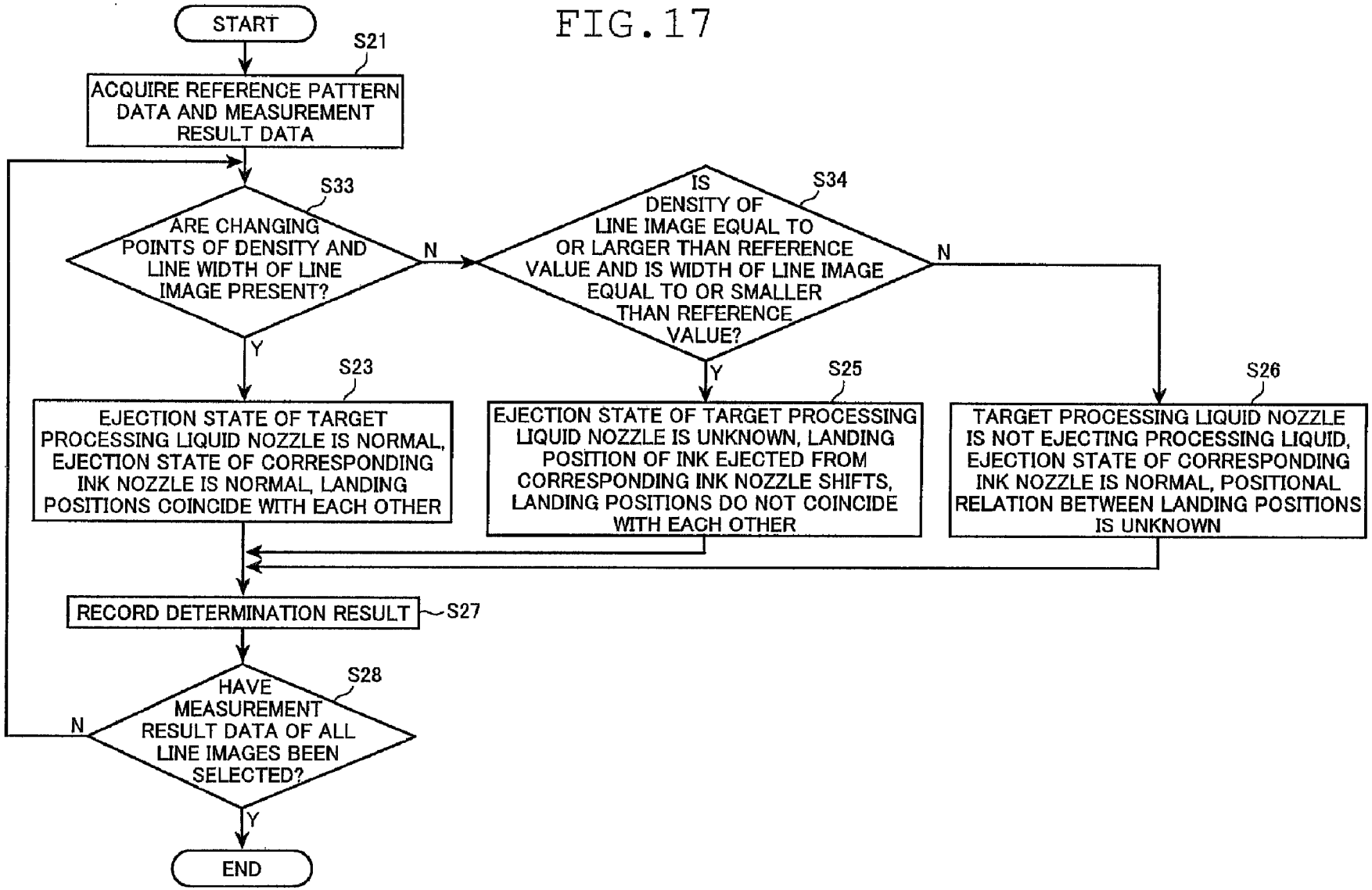
FIG. 17 is a flowchart of a method of determining whether one target processing liquid nozzle is ejecting processing liquid in the third embodiment.

A method of determining whether each of the target processing liquid nozzles is ejecting the processing liquid is described in detail with reference to FIG. 17.

As measurement result data, data representing a result obtained by measuring the density and the width of the line image illustrated in FIG. 16 is used.

First, in Step S21, the determining unit 28 acquires reference pattern data and measurement result data.

Subsequently, in Step S33, the determining unit 28 selects measurement result data of line images as determination targets out of the measurement result data and determines whether changing points in values of the density and the line width of the line images are present in the measurement result data.

For example, when the selected line images are the line images L5, L6, L10, L15, L19, and L24 illustrated in FIG. 16, changing points in values of the density and the line width of the line images are present in the measurement result data.

Therefore, in Step S23, the determining unit 28 determines that the target processing liquid nozzle is normally ejecting the processing liquid, determines that the corresponding ink nozzle is also normally ejecting the ink, and determines that landing positions of the processing liquid and the ink ejected by the target processing liquid nozzle and the corresponding ink nozzle coincide with each other.

On the other hand, when it is determined in Step S33 that changing points in the density and the line width of the line images are not present in the selected measurement result data of the line image, in Step S34, the determining unit 28 determines whether a value of the density of the line images indicated by the selected measurement result data of the line images is equal to or larger than a reference value Tc and a value of the line width of the line images is equal to or smaller than a reference value Tw.

The reference value Tc of the density of the line images is the density of a line image formed when landing positions of the processing liquid and the ink coincide with each other. The reference value Tw of the line width of the line images is the line width of the line image when landing positions of the processing liquid and the ink coincide with each other.

A method of calculating the reference values Tc and Tw is not specifically limited. In this embodiment, the reference pattern data described above is used.

As the reference value Tc of the density of the line images, a density value of a normal image recorded in the reference pattern data only has to be used. As the reference value Tw of the line width of the line images, the line width of the normal image recorded in the reference pattern data only has to be used.

For example, when the selected line image is the line image L23 illustrated in FIG. 16, a value of the density of the line image is equal to or larger than the reference value Tc and a value of the width of the line image is equal to or smaller than the reference value Tw.

Therefore, in Step S25, the determining unit 28 determines that it is unknown whether the target processing liquid nozzle is ejecting the processing liquid, determines that a landing position of the ink ejected from the corresponding ink nozzle shifts from a predetermined position (landing position of the processing liquid), and, therefore, determines that landing positions of the processing liquid and the ink ejected from the target processing liquid nozzle and the corresponding ink nozzle do not coincide with each other and shift in positions.

For example, when the selected line image is the line image L14 illustrated in FIG. 16, a value of the density of the line image is equal to or smaller than the reference value Tc and a value of the line width of the line image is equal to or larger than the reference value Tw. Therefore, in Step S26, the determining unit 28 determines that the target processing liquid nozzle is a non-ejecting nozzle, determines that the corresponding ink nozzle is a nozzle that is normally ejecting the ink, and determines that a positional relation between landing positions of the processing liquid and the ink ejected from the target processing liquid nozzle and the corresponding ink nozzle is unknown.

After the processing in any one of Steps S23, S25, and S26 is finished, in Step S27, a determination result is recorded in the determination result data.

Thereafter, in Step S28, the determining unit 28 determines whether the selection of measurement result data of all the line images is completed. When the selection of measurement result data is not completed, the determining unit 28 returns to Step S33. When the selection measurement result data is completed, the determining unit 28 finishes the determination concerning whether the target processing liquid nozzle is ejecting the processing liquid.

In the third embodiment, as in the first and second embodiments, it is possible to detect a non-ejecting processing liquid nozzle and a non-ejecting ink nozzle. This makes it possible to detect an image defect due to processing liquid non-ejection and an image defect due to ink non-ejection.

Fourth Embodiment

Next, a method of detecting a non-ejecting processing liquid nozzle according to a fourth embodiment of the present invention is described.

In the following description, differences from the second embodiment are mainly described. Description of components and processing same as those of the second embodiment is omitted for simple description.

In the fourth embodiment, the reference image illustrated in FIG. 13B used in the third embodiment is used as a reference image.

Figure 9:
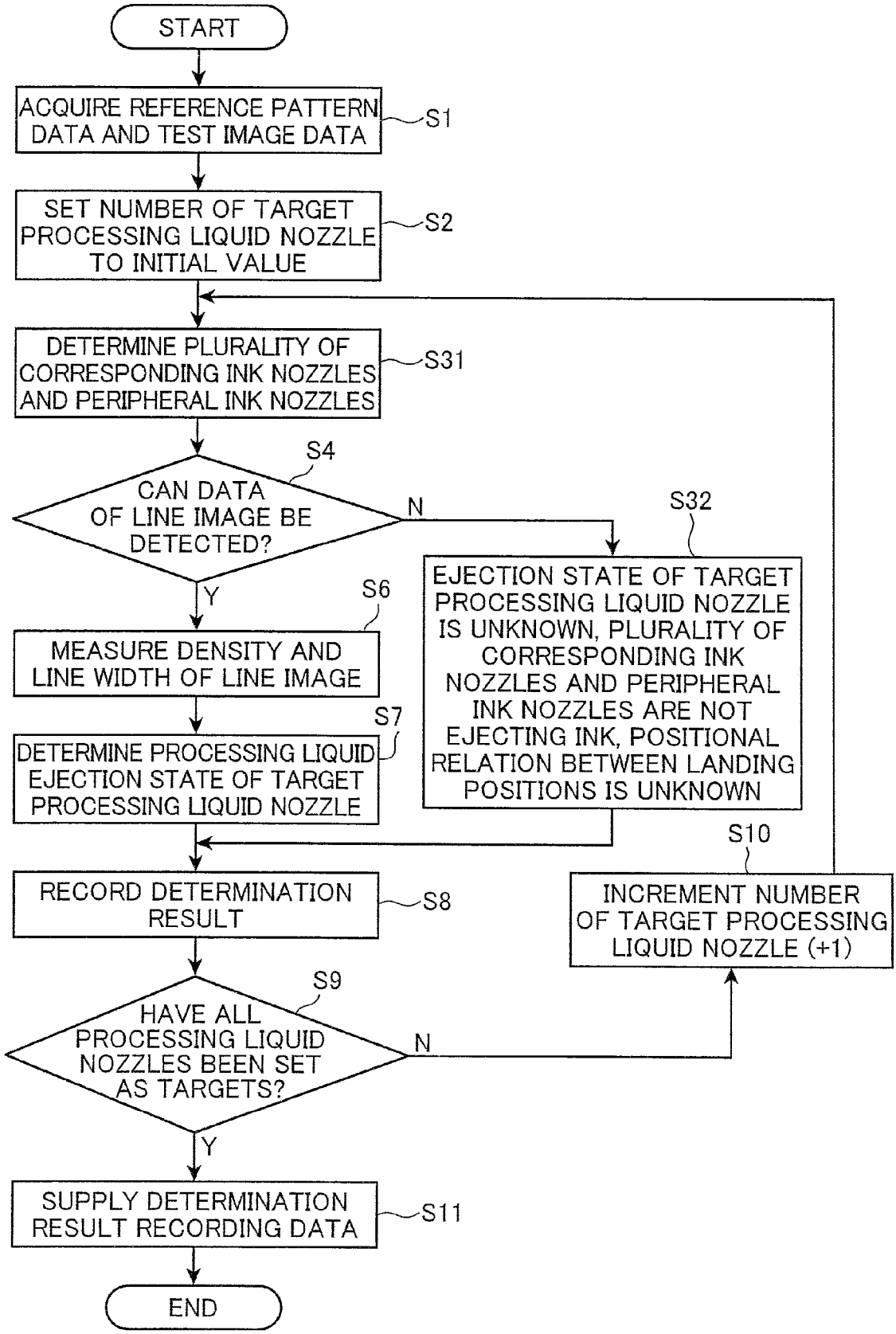
FIG. 9 is a flowchart of a method of detecting a non-ejecting processing liquid nozzle according to a second embodiment of the present invention.

An overall flow of the method of detecting a non-ejecting processing liquid nozzle according to the fourth embodiment is the same as the flow in the second embodiment illustrated in FIG. 9.

A method of determining an ejection state of each of the target processing liquid nozzles according to the fourth embodiment is described in detail.

In order to determine whether the target processing liquid nozzle is ejecting processing liquid, measurement result data and reference pattern data are used.

As described above, the measurement result data is a piece of data representing a result obtained by detecting data of a line image (line data) from test image data and measuring the density and the line width of the detected line image.

Therefore, first, the test image data is described.

The test image data of the fourth embodiment is digital data representing an image formed by depositing, with the corresponding ink nozzle and the peripheral ink nozzles, the ink on a specific area of a recording medium C on which the processing liquid is deposited in a pattern shape.

A method of generating test image data is not specifically limited. An example of the method is described with reference to FIGS. 18 and 19.

Figure 18:
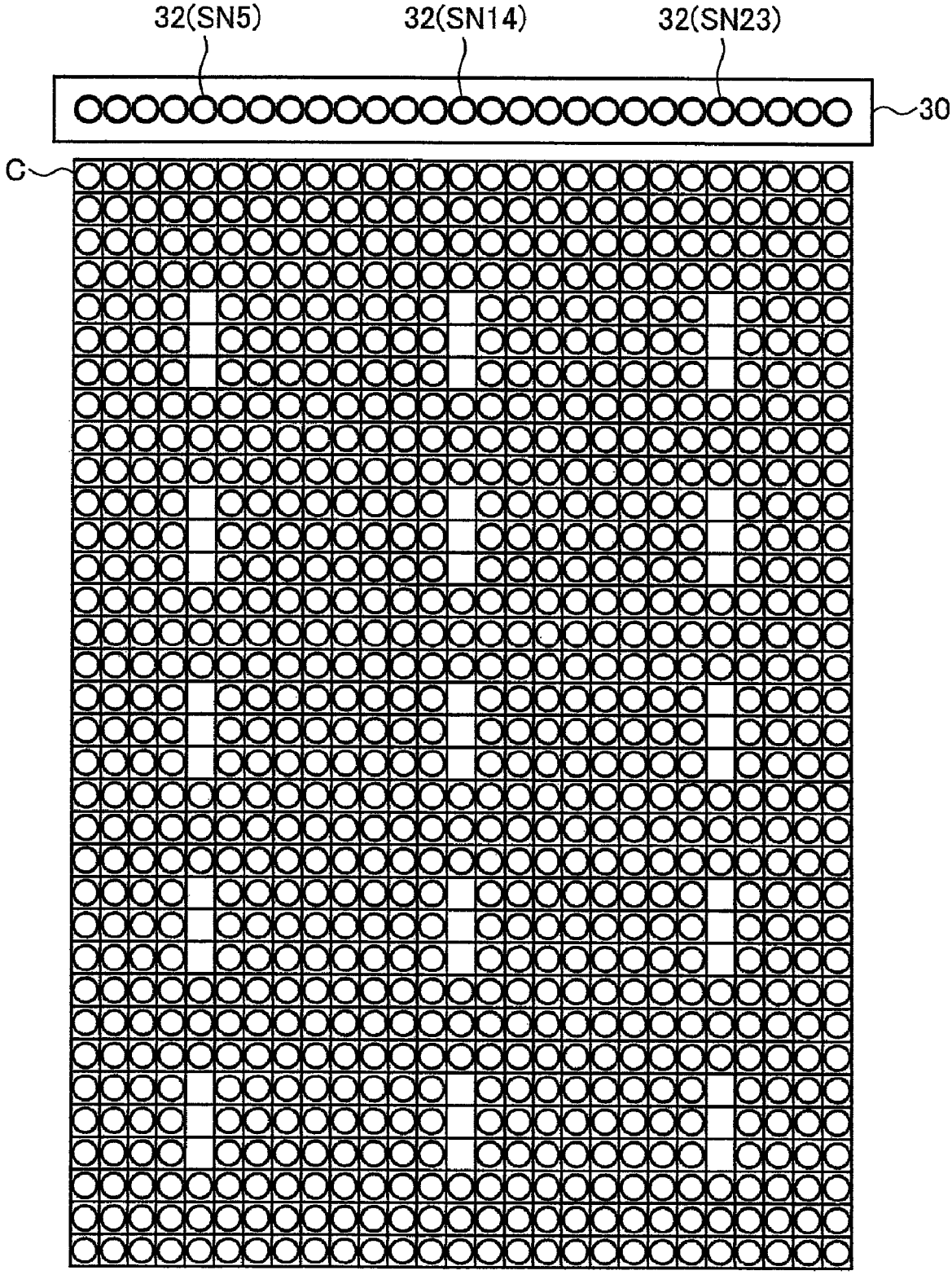
FIG. 18 is a schematic diagram of a recording medium and a processing liquid head according to a fourth embodiment of the present invention.

FIG. 18 is a schematic diagram of the recording medium C on which the processing liquid is deposited in a specific pattern shape excluding a predetermined area and a processing liquid head including twenty-seven processing liquid nozzles.

The recording medium C illustrated in FIG. 18 is different from the recording medium A in the third embodiment illustrated in FIG. 15 in that the same processing liquid deposited pattern is repeatedly formed five times. However, the processing liquid deposited pattern formed on the recording medium C illustrated in FIG. 18 is the same as the processing liquid deposited pattern P1 illustrated in FIG. 15 except that each of a processing liquid deposited area and a processing liquid non-deposited area is formed by three dots and a linear non-ejection detection target area including the processing liquid deposited area and the processing liquid non-deposited area is formed by six dots. Therefore, detailed explanation of the processing liquid deposited pattern is omitted.

Figure 19:
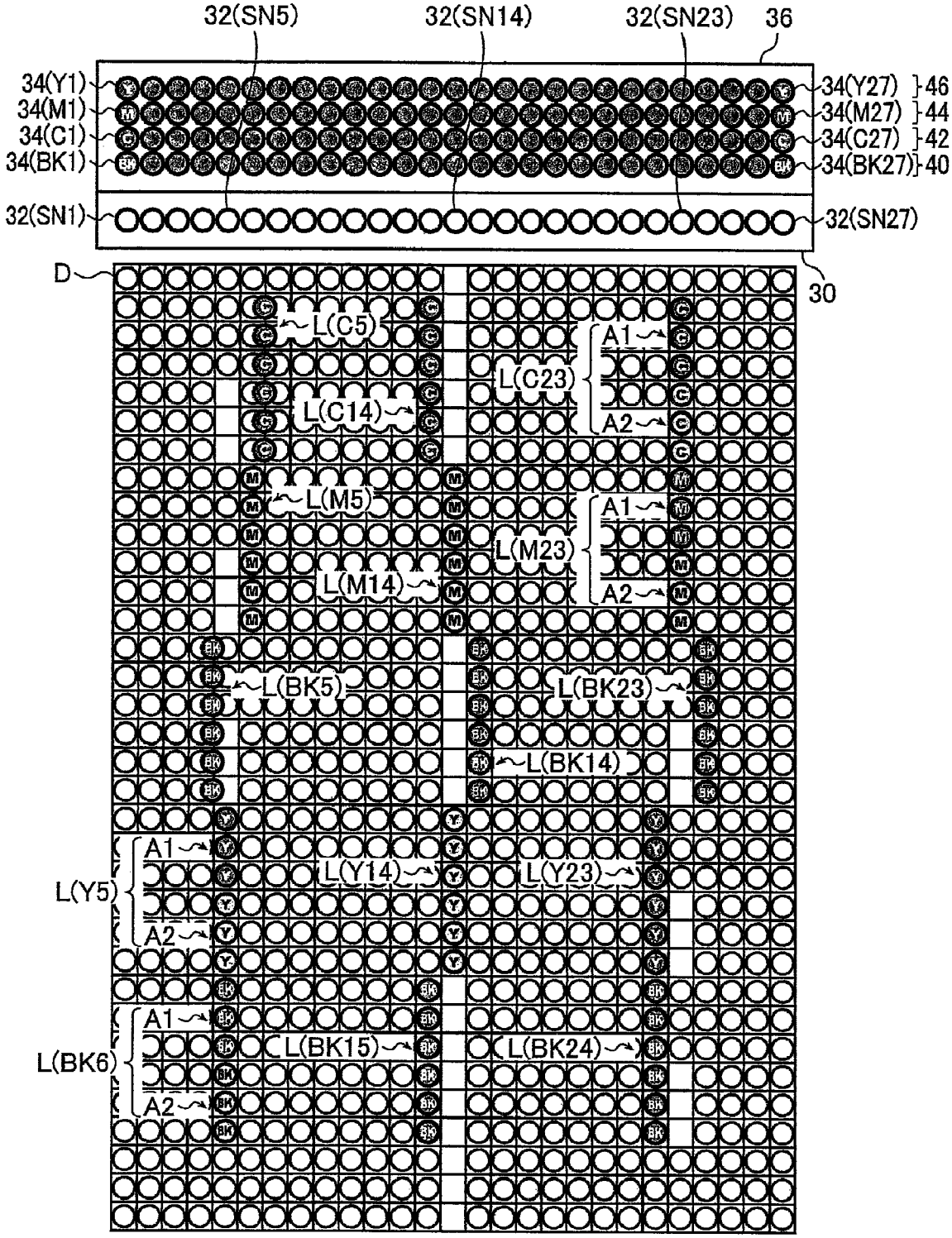
FIG. 19 is a schematic diagram of the recording medium and an ejection head in the fourth embodiment.

FIG. 19 is a schematic diagram of a recording medium D on which a processing liquid non-ejection detection pattern having a line image formed by depositing ink with corresponding ink nozzles or peripheral ink nozzles in a predetermined liner non-ejection detection target area of the recording medium C illustrated in FIG. 18 is formed and the ejection head 38.

The ejection head 38 includes the processing liquid head 30 and the ink head 36.

First, for example, the recording medium C is generated in the image recording unit 12.

Specifically, the recording medium C on which the same processing liquid deposited pattern illustrated in FIG. 18 is formed a plurality of times, in the example illustrated in FIG. 18, five times, is generated by using the processing liquid head 30.

For example, as illustrated in FIG. 18, when the processing liquid nozzles 32 with the numbers SN5, SN14, and SN23 are set as target processing liquid nozzles, the processing liquid head 30 and the recording medium C are relatively moved and the processing liquid is deposited on second to fourth rows, eighth to tenth rows, fourteenth to sixteenth rows, twentieth to twenty-second rows, and twenty-sixth to twenty-eighth rows by the processing liquid nozzles 32 with the numbers SN5, SN14, and SN23 of the processing liquid head 30 to form processing liquid deposited areas each formed by three processing liquid dots. On fifth to seventh rows, eleventh to thirteenth rows, seventeenth to nineteenth rows, twenty-third to twenty-fifth rows, and twenty-ninth to thirty-first rows, the processing liquid is not deposited and a processing liquid non-deposited area for three processing liquid dots is formed. With the other processing liquid nozzles 32, the processing liquid is deposited on all the rows to form processing dots on all the rows. Consequently, the recording medium C on which five same processing liquid deposited patterns, in which linear non-ejection detection target areas are respectively formed on the second to seventh rows, the eighth to thirteenth rows, the fourteenth to nineteenth rows, the twentieth to twenty-fifth rows, and the twenty-sixth to thirty-first rows corresponding to the processing liquid nozzles 32 with the numbers SN5, SN14, and SN23, are formed is generated.

The ink is deposited on a predetermined area the recording medium C illustrated in FIG. 18, by the corresponding ink nozzles and the peripheral ink nozzles to form a line image. The recording medium D having the line image is generated.

In this case, as illustrated in FIG. 19, the ink head 36 has nozzle lines, in which the twenty-seven ink nozzles 34 are linearly arranged, in order of black (BK), cyan (C), magenta (M), and yellow (Y) from the bottom of FIG. 28.

Numbers of the ink nozzles 34 in a black nozzle line 40 are BK1, BK2, . . . , and BK27 from the left of FIG. 28. Numbers of the ink nozzles 34 in a cyan nozzle line 42 are C1, C2, . . . , and C27 from the left of FIG. 28. Numbers of the ink nozzles 34 in a magenta nozzle line 44 are M1, M2, . . . , and M27 from the left of FIG. 28. Numbers of the ink nozzles 34 in a yellow nozzle line 46 are Y1, Y2, . . . , and Y27 from the left of FIG. 28.

When such an ink head 36 is used, for example, if the target processing liquid nozzle 32 is the processing liquid nozzle 32 (SN5), the corresponding ink nozzles 34 are the ink nozzles 34 (BK5, C5, M5 and Y5) and the peripheral ink nozzles 34 are, for example, the ink nozzle (BK6). If the target processing liquid nozzle 32 is the processing liquid nozzle 32 (SN14), the corresponding ink nozzles 34 are the ink nozzles 34 (BK14, C14, M14 and Y14). The peripheral ink nozzle 34 is, for example, the ink nozzle 34 (BK15). If the target processing liquid nozzle 32 is the processing liquid nozzle 32 (SN23), the corresponding ink nozzles 34 are the ink nozzles 34 (BK23, C23, M23 and Y23). The peripheral ink nozzle 34 is, for example, the ink nozzle 34 (BK24).

The ink nozzles 34 (C5, C14 and C23) deposit the ink only on the second to seventh rows of the recording medium C. The ink nozzles 34 (M5, M14 and M23) deposit the ink only on the eighth to thirteenth rows of the recording medium C. The ink nozzle 34 (BK5) deposit the ink only on the fourteenth to nineteenth rows of the recording medium C. The ink nozzles 34 (Y5, Y14 and Y23) deposit the ink only on the twentieth to twenty-fifth rows of the recording medium C. The ink nozzles 34 (BK6, BK14 and BK24) deposit the ink only on the twenty-sixth to thirty-first rows of the recording medium C. In this way, the ink nozzles 34 form line images on the recording medium C and generate the recording medium D having those line images.

A line image recorded by the ink nozzle 34 (C5) is represented as L(C5). A line image recorded by the ink nozzle 34

(Y14) is represented as L(Y14). Similarly, a line image recorded by the ink nozzle 34 (BK24) is represented as L(BK24).

Such a recording medium D is scanned by the image scanning device 14 and converted into digital data to generate test image data.

In order to generate measurement result data, data of the line images (line data) is detected from the test image data.

Image data representing line images L(C5), L(M5), L(BK5), L(Y5), L(BK6), L(C14), L(M14), L(BK14), L(Y14), L(BK15), L(C23), L(M23), L(BK23), L(Y23), and L(BK24) illustrated in FIG. 19 is detected from the test image data representing the recording medium D illustrated in FIG. 19.

Among the line images represented by the detected line image data, each of the line images L(Y5), L(BK6), L(C23), and L(M23) includes the normal image A1 that has predetermined density and line width because deposited processing liquid and ink overlap and the unprocessed image A2 in which the predetermined density and line width are not obtained because the deposited processing liquid and ink do not overlap.

In general, the unprocessed image A2 has low density and large width compared with the normal image A1.

Among the line images represented by the detected line image data, the line images L(M14) and L(Y14) are images recorded by depositing the ink on an area in which the processing liquid is not deposited at all. On the other hand, the line images L(C5), L(BK5), L(C14), L(BK14), L(BK15), L(BK23), L(Y23), and L(BK24) are images recorded by, because a landing position of the ink changes, depositing the ink on an area in which the processing liquid is deposited. The line image L(M5) is an image recorded by the ink nozzle 34 (M5) without depositing the ink.

The predetermined density in this case is the density of a line image formed when landing positions of the processing liquid and the ink coincide with each other. On the other hand, the predetermined line width is the width of the line image formed when landing positions of the processing liquid and the ink coincide with each other.

After the data of the line images (line data) are detected, the density and the line width of the line images represented by the data are measured and a result of the measurement is recorded to generate measurement result data.

In the measurement result data of the line images including the normal images A1 and the unprocessed images A2 such as the line images L(Y5), L(BK6), L(C23), and L(M23), since the processing liquid and the ink overlap in data of the normal image A1, values representing the predetermined density and line width can be obtained from the data of the normal image A1. On the other hand, since the processing liquid and the ink do not overlap in data of the unprocessed image A2, values representing the predetermined density and line width cannot be obtained from the data of the unprocessed image A2.

The ink nozzle 34 (M5) is not ejecting the ink, and hence the measurement result data of the line image L(M5) cannot be detected as a colored line image. Values representing the density and the line width thereof cannot be obtained at all.

In the measurement result data of the line images L(M14) and L(Y14), since the processing liquid and the ink overlap, values representing the predetermined density and width can be obtained from the measurement result data. On the other hand, in the measurement result data of the line images L(C5), L(BK5), L(C14), L(BK14), L(BK15), L(BK23), L(Y23), and L(BK24), since a landing position of the ink changes, values representing the normal image A1 and the unprocessed image A2 cannot be obtained from the measurement result data.

The values representing the predetermined density and line width are the same as the values representing the reference value of the third embodiment.

Figure 20:
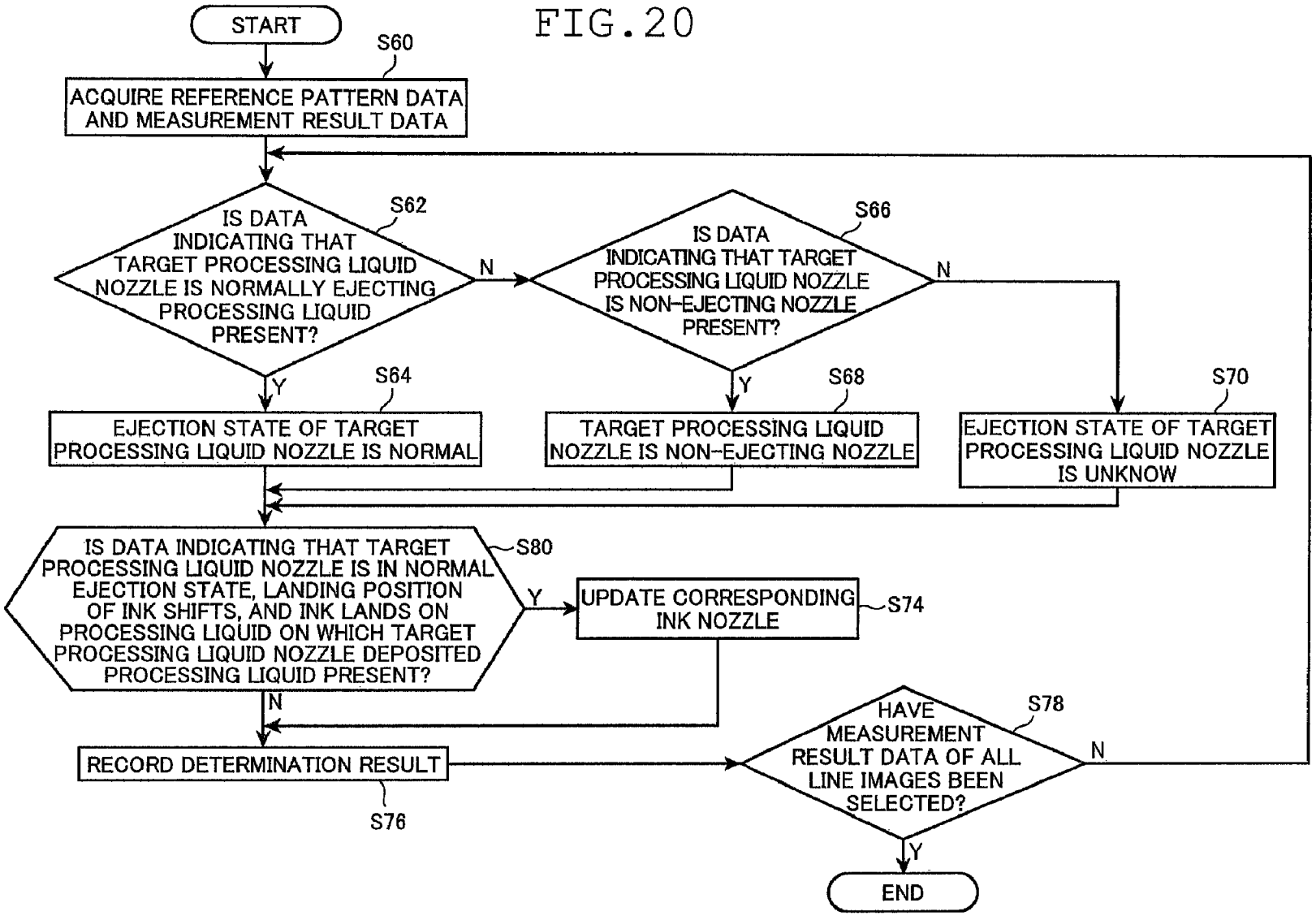
FIG. 20 is a flowchart of a method of determining whether one target processing liquid nozzle is ejecting processing liquid in the fourth embodiment.

A method of determining whether each of the target processing liquid nozzles is ejecting the processing liquid is described in detail with reference to FIG. 20.

First, in Step S60, the determining unit 28 acquires reference pattern data and measurement result data.

Subsequently, in Step S62, the determining unit 28 determines, using the reference pattern data, whether data indicating that the target processing liquid nozzle 32 is normally ejecting the processing liquid is present in measurement result data of line images recorded in association with the target processing liquid nozzle 32.

As a result of the determination, when it is determined that relevant data is present, in Step S64, the determining unit 28 determines that the target processing liquid nozzle 32 is normally ejecting the processing liquid.

On the other hand, when it is determined in Step S62 that relevant data is not present, the determining unit 28 proceeds to Step S66 and determines, using the reference pattern data, whether data indicating that the target processing liquid nozzle is a non-ejecting nozzle is present in the selected measurement result data of the line images.

As a result of the determination, when it is determined that relevant data is present, in Step S68, the determining unit 28 determines that the target processing liquid nozzle is a non-ejecting nozzle.

On the other hand, when it is determined in Step S66 that relevant data is not present, in Step S70, the determining unit 28 determines that the ejection state of the target processing liquid nozzle is unknown.

After Step S64, S68, or S70, in Step S80, the determining unit 28 determines whether data representing that the target processing liquid nozzle is normally ejecting the processing liquid and representing that, although a landing position of the ink shifts, the ink lands on the processing liquid deposited by the target processing liquid nozzle is present in the selected measurement result data of the line images.

As a result of the determination, when it is determined that relevant data is present, in Step S74, the determining unit 28 updates an ink nozzle corresponding to the target processing liquid nozzle. In other words, the determining unit 28 sets, as a new corresponding ink nozzle, an ink nozzle that records the data determined in Step S80.

On the other hand, when it is determined in Step S80 that relevant data is not present, in Step S76, the determining unit 28 records a determination result of Step S64, S68, or S70 and a processing result of Step S74 in determination result recording data.

Thereafter, in Step S78, the determining unit 28 determines whether measurement result data of all the line images are selected.

When measurement result data of line images that should be selected still remain, the determining unit 28 returns to Step S62 and repeats Steps S62 to S78. On the other hand, when it is determined in Step S78 that measurement result data of all the line images are selected, the determining unit 28 finishes the detection of non-ejecting processing liquid nozzle.

Specifically, a method of determining an ejection state of each of the target processing liquid nozzles at the time when data obtained by measuring the density and the line width of the line images illustrated in FIG. 19 is used as measurement result data is described.

For example, after acquiring reference pattern data and measurement result data in Step S60, the determining unit 28 selects measurement result data of line images recorded in association with the target processing liquid nozzle 32 (SN5), that is, measurement result data of the line images L(C5, M5, BK5, Y5, and BK6). In Step S62, the determining unit 28 determines whether data indicating that the target processing liquid nozzle is normally ejecting the processing liquid is present in the selected data.

In this case, if data representing line images having the density and the width thereof changed is present in the selected measurement result data, the determining unit 28 only has to check whether data of line images having data from which values representing predetermined density and width are obtained and data from which values representing the predetermined density and width are not obtained is present.

Measurement result data of the line images L(Y5 and BK6) having data having values representing the predetermined density and width and data not having values representing the predetermined density and width is present in the selected measurement result data. Therefore, in Step S64, the determining unit 28 can determine that the target processing liquid nozzle 32 (SN5) is normally ejecting the processing liquid.

The determining unit 28 can also determine, from a result of the determination and measurement result data of the line image L(M5) not having values representing the density and the width thereof at all, that the ink nozzle 34 (M5) is a non-ejecting ink nozzle.

Subsequently, in Step S80, the determining unit 28 checks whether data indicating that, although a landing position of the ink shifts, the ink lands on the processing liquid deposited by the target processing liquid nozzle is present in the selected measurement result data.

In this case, the determining unit 28 only has to check whether there is measurement result data of a line image on which the ink deposited by an ink nozzle, which is not expected to deposit the ink on a position on which the target processing liquid nozzle 32 deposits the processing liquid, and the processing liquid deposited by the target processing liquid nozzle 32 overlap, that is, measurement result data of a line image that is recorded by the peripheral ink nozzles and has data having values representing the predetermined density and width and data not having values representing the predetermined density and width.

Measurement result data of the line image L(BK6) that is recorded by the peripheral ink nozzles and has data having values representing the predetermined density and width and data not having values representing the predetermined density and width is present in the selected measurement result data. Therefore, in Step S74, the determining unit 28 updates the ink nozzle 34 for black corresponding to the target processing liquid nozzle (SN5) to the ink nozzle 34 (BK6).

Subsequently, in Step S76, the determining unit 28 records determination results obtained in Steps S64 and S74 in the determination result recording data. In Step S78, the determining unit 28 determines whether measurement result data of all the line images are selected. Then, it is confirmed that other measurement result data of a line image not selected yet is present.

Therefore, for example, the determining unit 28 selects measurement result data of line images recorded in association with the target processing liquid nozzle (SN23), that is, measurement result data of the line images L(C23, M23, BK23, Y23, and BK24). In Step S62, the determining unit 28 determines whether data indicating that the target processing liquid nozzle is normally ejecting the processing liquid is present in the measurement result data.

In this case, measurement result data of the line images L(C23 and M23) having data having values representing the predetermined density and width and data not having values of the predetermined density and width is present in the selected measurement result data. Therefore, in Step S64, the determining unit 28 can determine that the target processing liquid nozzle (SN23) is normally ejecting the processing liquid.

Subsequently, in Step S80, the determining unit 28 determines whether data indicating that, although a landing position of the ink shifts, the ink lands on the processing liquid deposited by the target processing liquid nozzle is present in the selected measurement result data.

Relevant line image data cannot be confirmed in the selected measurement result data, and hence, in Step S76, the determining unit 28 records a determination result obtained in Step S64 in the determination result data. In Step S78, the determining unit 28 determines whether measurement data of all the line images is selected.

As a result, it is confirmed that measurement result data of a line image not selected yet is present.

Therefore, the determining unit 28 selects, for example, measurement result data of line images recorded in association with the target processing liquid nozzle (SN14), that is, measurement result data of the line images L(C14, M14, BK14, Y14, and BK15). In Step S62, the determining unit 28 determines whether data indicating that the target processing liquid nozzle is normally ejecting the processing liquid is present in the selected measurement result data.

Data representing that the target processing liquid nozzle is normally ejecting the processing liquid is not present in the selected measurement result data, and hence, in Step S66, the determining unit 28 determines whether data indicating that the target processing liquid nozzle is a non-ejecting nozzle is present.

In this case, if none of the selected measurement result data is measurement result data of line images having data from which values representing the predetermined density and width are obtained and data from which values representing the predetermined density and width are not obtained, and measurement result data of line images having only values not having values representing the predetermined density and width at all is present in the selected measurement result data, the determining unit 28 can determine that the target processing liquid nozzle is a non-ejecting nozzle.

None of the data of the selected line images L(C14, M14, BK14, Y14, and BK15) is measurement result data of line images having data from which values representing the predetermined density and width are obtained and data from which values representing the predetermined density and width are not obtained. In addition, measurement result data of the line images L(M14 and Y14) having only values not having values representing the predetermined density and width at all is present in the selected measurement result data. Therefore, in Step S68, the determining unit 28 determines that the target processing liquid nozzle (SN14) is a non-ejecting nozzle.

Subsequently, in Step S80, the determining unit 28 determines whether data indicating that, although a landing position of the ink shifts, the ink lands on the processing liquid deposited by the target processing liquid nozzle is present in the selected measurement result data.

Relevant line image data is not confirmed in the selected measurement result data, and hence, in Step S76, the determining unit 28 records a determination result obtained in Step S68 in the determination result data. In Step S78, the determining unit 28 determines whether measurement result data of all the line images are selected.

As a result, since other measurement result data of a line image not selected yet is not present, the determining unit 28 finishes the determination concerning whether the target processing liquid nozzle is ejecting the processing liquid.

As described above, in the fourth embodiment, as in the first to third embodiments, it is possible to detect a non-ejecting processing liquid nozzle and a non-ejecting ink nozzle. This makes it possible to detect an image defect due to processing liquid non-ejection and an image defect due to ink non-ejection.

Further, it is possible to simultaneously determine ink nozzles associated with the target processing liquid nozzle anew according to a landing position of the ink of the ink nozzles and associate the ink nozzles in addition to detecting the non-ejecting processing liquid nozzle and the non-ejecting ink nozzle.

In the first to fourth embodiments, a portion where the processing liquid and the ink do not overlap in the line images used in detecting a non-ejecting processing liquid nozzle is extremely small. In other words, an area that is likely to cause a fixing failure because the ink does not overlap the processing liquid on the recording medium is extremely small. Therefore, an unfixed ink on the recording medium hardly adheres to and contaminates means for conveying the recording medium. It is possible to detect a non-ejecting ink nozzle.

In the respective embodiments, the reference pattern data and the test image data are acquired from the image scanning device 14. However, the present invention is not limited thereto. For example, when the reference pattern data and the test image data are stored in a server or the like, the reference pattern data and the test image data may be acquired from the server.

The non-ejecting nozzle detecting method and the non-ejecting nozzle detecting device according to the present invention are described above. However, the present invention is not limited to the above-mentioned embodiments. It goes without saying that various improvement and modifications may be made without departing from the spirit of the present invention.

What is claimed is:

1. A non-ejecting nozzle detecting method used in an inkjet recording method of depositing transparent processing liquid and colored ink from processing liquid nozzles and ink nozzles, respectively, onto a recording medium one on top of another to form an image and fixing and recording the colored inks, the non-ejecting nozzle detecting method comprising:

setting a processing liquid deposited pattern so that, by processing liquid nozzles selected not to be adjacent to one another as non-ejection detection targets, linear non-ejection detection target areas are formed in which the processing liquid is continuously deposited for a predetermined number of dots while gradually changing density of the processing liquid to be deposited to one of increase and decrease in one direction, and, by remaining processing liquid nozzles not selected as the non-ejection detection targets, the processing liquid is continuously deposited while the density of the processing liquid is changed in a direction opposite to the one direction of the linear non-ejection detection target areas;

ejecting the processing liquid from the processing liquid nozzles onto the recording medium to form the processing liquid deposited pattern on the recording medium according to the set processing liquid deposited pattern;

ejecting the colored ink from the ink nozzles corresponding to the processing liquid nozzles selected as the non-ejection detection targets onto the processing liquid deposited pattern, and recording linear colored ink images on the recording medium to thereby form a processing liquid non-ejection detection pattern on the recording medium;

scanning the processing liquid non-ejection detection pattern with a detection sensor;

detecting the linear colored ink images in the processing liquid non-ejection detection pattern scanned by the detection sensor;

measuring densities and line widths of the detected linear colored ink images; and detecting, based on changes in the measured densities and line widths of the linear colored ink images, a non-ejecting processing liquid nozzle from the processing liquid nozzles selected as the non-ejection detection targets.

2. The non-ejecting nozzle detecting method according to claim 1, wherein the density of the processing liquid is controlled by controlling at least one of a liquid quantity of the processing liquid deposited from the processing liquid nozzles onto one processing liquid dot, a size of the one processing liquid dot, the density of the processing liquid forming the one processing liquid dot, and an ejection ratio of the processing liquid onto the one processing liquid dot.

3. The non-ejecting nozzle detecting method according to claim 1, further comprising selecting a plurality of different combinations of processing liquid nozzles out of all the processing liquid nozzles so that all the processing liquid nozzles are selected as the non-ejection detection targets, and continuously combining a plurality of the processing liquid deposited patterns respectively corresponding to the plurality of different combinations of processing liquid nozzles.

4. The non-ejecting nozzle detecting method according to claim 1, further comprising detecting the processing liquid nozzle corresponding to the linear non-ejection detection target area as the non-ejecting processing liquid nozzle when both the density and the line width of the formed linear colored ink image do not change.

5. The non-ejecting nozzle detecting method according to claim 1, further comprising detecting the changes in the densities and the line widths of the linear colored ink images scanned by the detection sensor, and detecting positional shift between the processing liquid nozzle selected as the non-ejection detection target and the ink nozzle corresponding to the selected processing liquid nozzle.

6. The non-ejecting nozzle detecting method according to claim 5, further comprising detecting that the processing liquid nozzle and the ink nozzle corresponding to the processing liquid nozzle positionally shift to each other when the change in the density of the linear colored ink image corresponding to the linear non-ejection detection target area is opposite to the change in the density of the processing liquid in the linear non-ejection detection target area and the line width of the linear colored ink image changes to increase in a direction in which the density of the processing liquid in the linear non-ejection detection target area increases.

7. The non-ejecting nozzle detecting method according to claim 5, further comprising:

detecting the changes in the density and the line width of the linear colored ink image formed by the colored ink ejected from peripheral ink nozzles of the ink nozzle corresponding to the processing liquid nozzle when the positional shift between the processing liquid nozzle and the ink nozzle corresponding to the processing liquid nozzle is detected; and setting the peripheral ink nozzles as ink nozzles corresponding to the processing liquid nozzle that has formed the linear non-ejection detection target area when the detected change in the density of the linear colored ink image is the same as the change in the density of the processing liquid in the linear non-ejection detection target area and the line width of the linear colored ink image changes to decrease in a direction in which the density of the processing liquid in the linear non-ejection detection target area increases.

8. The non-ejecting nozzle detecting method according to claim 1, further comprising detecting presence/absence of non-ejection of the ink nozzle based on the changes in the measured density and line width of the linear colored ink image.

9. The non-ejecting nozzle detecting method according to claim 8, further comprising detecting the ink nozzle corresponding to the processing liquid nozzle, which has formed the linear non-ejection detection target area, as a non-ejection ink nozzle when the linear colored ink image corresponding to the linear non-ejection detection target area is not formed.

10. The non-ejecting nozzle detecting method according to claim 1, further comprising:

repeatedly ejecting the processing liquid from the processing liquid nozzles onto the recording medium to thereby repeatedly form the same processing liquid deposited pattern on the recording medium;

setting, as ink nozzles corresponding to the processing liquid nozzles selected as the non-ejection detection targets, a plurality of types of ink nozzles that eject colored ink of colors different from one another, repeatedly ejecting the colored ink by each ink nozzle of the set plurality of types of ink nozzles and a plurality of peripheral ink nozzles around the set plurality of types of ink nozzles onto one processing liquid deposited pattern formed on the recording medium to form the linear colored ink images on the recording medium while changing a type of the ink nozzle and a color of the colored ink, and recording a plurality of the linear colored ink images on the recording medium for each of a plurality of the colors to form the processing liquid non-ejection detection pattern on the recording medium;

scanning the processing liquid non-ejection detection pattern formed on the recording medium with the detection sensor;

detecting the plurality of the linear colored ink images in the processing liquid non-ejection detection pattern scanned by the detection sensor;

measuring densities and line widths of the detected plurality of kinds of linear colored ink images; and determining, based on changes in the measured densities and line widths of the plurality of the linear colored ink images, presence/absence of non-ejection of the processing liquid nozzles selected as the non-ejection detection targets.

11. The non-ejecting nozzle detecting method according to claim 10, further comprising detecting positional shift between the processing liquid nozzle and the ink nozzle corresponding to the processing liquid nozzle and setting the plurality of peripheral ink nozzles as ink nozzles corresponding to the processing liquid nozzle, which has formed the linear non-ejection detection target area, when the change in the density of the linear colored ink image formed by ejecting the colored ink from the peripheral ink nozzles is the same as the change in the density of the processing liquid in the linear non-ejection detection target area and the line width of the linear colored ink image changes to decrease in a direction in which the density of the processing liquid in the linear non-ejection detection target area increases.

12. A non-ejecting nozzle detecting device used in an inkjet recording apparatus that deposits transparent processing liquid and colored ink from processing liquid nozzles and ink nozzles of an inkjet head, respectively, onto a recording medium one on top of another to form an image and fixes and records the colored ink, the non-ejecting nozzle detecting device comprising:

a nozzle setting unit that selects processing liquid nozzles not to be adjacent to one another out of all the processing liquid nozzles as non-ejection detection targets;

a processing liquid deposited pattern setting unit that sets a processing liquid deposited pattern so that the processing liquid nozzles selected as the non-ejection detection targets continuously deposit the processing liquid for a predetermined number of dots while gradually changing density of the processing liquid to be deposited to one of increase and decrease in one direction to form linear non-ejection detection target areas, and remaining processing liquid nozzles not selected as the non-ejection detection targets continuously deposit the processing liquid while the density of the processing liquid is changed in a direction opposite to the one direction of the linear non-ejection detection target areas;

an ejection control unit that performs ejection control for the processing liquid nozzles to eject the processing liquid from the processing liquid nozzles onto the recording medium to form the processing liquid deposited pattern on the recording medium according to the set processing liquid deposited pattern, and performs ejection control for the ink nozzles to eject the colored ink from the ink nozzles corresponding to the processing liquid nozzles selected as the non-ejection detection targets onto the processing liquid deposited pattern and record a linear colored ink images on the recording medium to thereby form a processing liquid non-ejection detection pattern on the recording medium;

a data acquiring unit that scans the processing liquid non-ejection detection pattern with a detection sensor and acquires image data of the linear colored ink image in the scanned processing liquid non-ejection detection pattern;

a measuring unit that measures densities and line widths of the linear colored ink images; and a detecting unit that detects, based on changes in the densities and the line widths of the linear colored ink images measured by the measuring unit, a non-ejecting processing liquid nozzle from the processing liquid nozzles selected as the non-ejection detection targets.

13. The non-ejecting nozzle detecting device according to claim 12, wherein the detecting unit detects the processing liquid nozzle corresponding to the linear non-ejection detection target area as the non-ejecting processing liquid nozzle when both the density and the line width of the formed linear colored ink image do not change.

14. The non-ejecting nozzle detecting device according to claim 12, wherein:

the ejection control unit controls the processing liquid nozzles, a plurality of types of ink nozzles and the plurality of peripheral ink nozzles to repeatedly eject the processing liquid from the processing liquid nozzles onto the recording medium to thereby repeatedly form the same processing liquid deposited pattern on the recording medium according to the processing liquid deposited pattern set by the processing liquid deposited pattern setting unit, and set, as ink nozzles corresponding to the processing liquid nozzles selected as the non-ejection detection targets, a plurality of types of ink nozzles that eject colored ink of colors different from one another, repeatedly eject the colored ink by each ink nozzle of the set plurality of types of ink nozzles and the plurality of peripheral ink nozzles onto the same processing liquid deposited pattern formed on the recording medium to form the linear colored ink images on the recording medium while changing a type of the ink nozzle and a color of the colored ink, and record a plurality of the linear colored ink images on the recording medium for each of a plurality of the colors to form the processing liquid non-ejection detection pattern on the recording medium;

the data acquiring unit scans the processing liquid non-ejection detection pattern formed on the recording medium with the detection sensor and acquires image data of the plurality of the linear colored ink images in the scanned processing liquid non-ejection detection pattern;

the measuring unit measures densities and line widths of the plurality of the linear colored ink images; and the detecting unit determines, based on changes in the densities and line widths of the plurality of the linear colored ink images measured by the measuring unit, presence/absence of non-ejection of the processing liquid nozzles selected as the non-ejection detection targets.

15. The non-ejecting nozzle detecting device according to claim 14, wherein the detecting unit detects positional shift between the processing liquid nozzle and the ink nozzle corresponding to the processing liquid nozzle, and sets the plurality of peripheral ink nozzles as ink nozzles corresponding to the processing liquid nozzle, which has formed the linear non-ejection detection target area, when the change in the density of the linear colored ink image formed by ejecting the colored ink from the plurality of peripheral ink nozzles is the same as the change in the density of the processing liquid in the linear non-ejection detection target area and the line width of the linear colored ink image changes to decrease in a direction in which the density of the processing liquid in the linear non-ejection detection target area increases.

16. An inkjet recording apparatus, comprising:

an inkjet head comprising processing liquid nozzles and ink nozzles that deposit transparent processing liquid and colored ink onto a recording medium, respectively, one on top of another to form an image;

fixing means for fixing the colored ink deposited on the recording medium to form the image;

moving means for relatively moving the recording medium and the inkjet head; and the non-ejecting nozzle detecting device according to claim 12.

* * * * *